US010965054B2

(12) United States Patent
Naganuma

(10) Patent No.: US 10,965,054 B2
(45) Date of Patent: Mar. 30, 2021

(54) CABLE CONNECTOR HAVING CABLE HOLDERS

(71) Applicant: HIROSE ELECTRIC CO., LTD., Tokyo (JP)

(72) Inventor: Kenichi Naganuma, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 10 days.

(21) Appl. No.: 16/317,771

(22) PCT Filed: Jul. 11, 2017

(86) PCT No.: PCT/JP2017/025285
§ 371 (c)(1),
(2) Date: Jan. 14, 2019

(87) PCT Pub. No.: WO2018/016389
PCT Pub. Date: Jan. 25, 2018

(65) Prior Publication Data

US 2019/0237898 A1 Aug. 1, 2019

(30) Foreign Application Priority Data

Jul. 20, 2016 (JP) ..... JP2016-142464

(51) Int. Cl.
*H01R 13/506* (2006.01)
*H01R 13/56* (2006.01)
(Continued)

(52) U.S. Cl.
CPC ..... *H01R 13/506* (2013.01); *H01R 4/2429* (2013.01); *H01R 13/56* (2013.01);
(Continued)

(58) Field of Classification Search
CPC .. H01R 13/514; H01R 13/506; H01R 13/405; H01R 4/24; H01R 4/2429; H01R 24/60;
(Continued)

(56) References Cited

U.S. PATENT DOCUMENTS 4,108,527 A * 8/1978 Douty ..... H01R 13/627 439/465
4,611,887 A * 9/1986 Glover ..... G02B 6/3831 385/69
(Continued)

FOREIGN PATENT DOCUMENTS

CN 201112575 Y 9/2008
CN 201185236 Y 1/2009
(Continued)

OTHER PUBLICATIONS

International Search Report dated Sep. 19, 2017 filed in PCT/JP2017/025285.
(Continued)

*Primary Examiner* — Renee S Luebke
*Assistant Examiner* — Milagros Jeancharles
(74) *Attorney, Agent, or Firm* — Rankin, Hill & Clark LLP

(57) ABSTRACT

For example, the provision of a cable connector where a cable holder can maintain the position of a member where the cable holder is mounted, before and after the mounting. The cable connector includes a housing and paired cable holders. One end of a cable can be mounted in each of the paired cable holders. Each of the paired cable holders includes a cantilevered arm portion extending in a mounting direction of the cable holder on the housing. At least part of the arm portion can come face to face with part of the housing in a direction along a lead-out direction of the cable
(Continued)

from the cable holder, at the time and after the mounting of the cable holder on the housing.

9 Claims, 15 Drawing Sheets

(51) Int. Cl.
*H01R 4/2429* (2018.01)
*H01R 43/01* (2006.01)
*H01R 43/18* (2006.01)
*H01R 13/405* (2006.01)

(52) U.S. Cl.
CPC ..... *H01R 43/01* (2013.01); *H01R 43/18* (2013.01); *H01R 13/405* (2013.01)

(58) Field of Classification Search
CPC .... H01R 43/01; H01R 43/18; H01R 13/6585; H01R 13/6592
See application file for complete search history.

(56) References Cited

U.S. PATENT DOCUMENTS 5,076,656 A * 12/1991 Briggs ..... G02B 6/3807 385/60
5,104,336 A 4/1992 Hatanaka
5,398,295 A * 3/1995 Chang ..... G02B 6/3879 385/136
5,498,172 A * 3/1996 Noda ..... H01R 12/616 439/404
5,713,756 A * 2/1998 Abe ..... H01R 4/2429 439/404
5,908,327 A * 6/1999 Tsuji ..... H01R 13/506 439/470
5,964,620 A * 10/1999 Takahashi ..... H01R 9/0518 439/579
6,176,745 B1 * 1/2001 Furutani ..... H01R 13/506 439/701
6,336,831 B1 * 1/2002 Abe ..... H01R 13/506 439/701
6,375,491 B1 * 4/2002 Durand ..... H01R 13/6467 439/418
6,439,920 B1 * 8/2002 Chen ..... H01R 4/2404 439/418
6,450,829 B1 * 9/2002 Weisz-Margulescu ..... H01R 13/424 439/263
6,783,402 B2 * 8/2004 Chen ..... H01R 24/64 439/344
6,869,306 B1 * 3/2005 Sung ..... H01R 13/506 439/449
6,932,640 B1 * 8/2005 Sung ..... H01R 4/2433 439/405
7,021,959 B2 * 4/2006 Tsuji ..... H01R 13/562 439/470
7,070,457 B2 * 7/2006 Kluempke ..... H01R 13/514 439/687
7,081,003 B1 * 7/2006 Gregori ..... H01R 13/516 439/352
7,329,137 B2 * 2/2008 Martin ..... H01R 13/501 439/344
7,878,833 B2 * 2/2011 Chen ..... H01R 13/5045 439/284
7,903,923 B2 * 3/2011 Gronvall ..... G02B 6/4441 385/135
8,052,461 B2 * 11/2011 Wang ..... H01R 4/2433 439/405
8,915,758 B2 * 12/2014 Shishikura ..... H01R 13/514 439/701
9,837,729 B2 * 12/2017 Lin ..... H01R 4/2433
9,967,440 B2 * 5/2018 Larsson ..... H04N 5/2253
10,734,766 B2 * 8/2020 Naganuma ..... H01R 13/658
2001/0053631 A1 * 12/2001 Nagai ..... H01R 4/2433 439/625
2008/0119084 A1 * 5/2008 Hitchcock ..... H01R 13/4223 439/541.5
2008/0280483 A1 * 11/2008 Curtis ..... H01R 4/2433 439/491
2009/0017684 A1 1/2009 Lin
2010/0178794 A1 7/2010 Hsu
2012/0058667 A1 3/2012 Carreras Garcia
2012/0302103 A1 * 11/2012 Su ..... G02B 6/3817 439/660
2013/0130549 A1 * 5/2013 Wu ..... H01R 13/6598 439/607.01
2013/0337676 A1 12/2013 Hsueh
2018/0019548 A1 * 1/2018 Maesoba ..... H01R 13/648
2019/0229438 A1 * 7/2019 Naganuma ..... H01R 13/502
2020/0358227 A1 * 11/2020 Henry ..... H01R 13/6592

FOREIGN PATENT DOCUMENTS

JP H03141561 A 6/1991
JP H11297403 A 10/1999
JP 2003171624 A 6/2003
JP 2010277861 A 12/2010
WO 99/66598 12/1999

OTHER PUBLICATIONS

Chinese Office Action dated Dec. 31, 2019 for the corresponding Chinese Patent Application No. 201780044700.2. and its English machine translation.
Extended European Search Report dated Feb. 3, 2020 for the corresponding European Patent Application No. 17830908.4.

* cited by examiner

CABLE CONNECTOR HAVING CABLE HOLDERS

TECHNICAL FIELD

The present invention relates to a cable connector having cable holders.

BACKGROUND ART

A cable holder configured as a separate body from a main body of a housing may be used to hold a cable. For example, Patent Document 1 illustrates an example of an insulation-displacement connector having a pair of fixing portions where a plurality of cables can be mounted. FIG. 23 illustrates an exploded perspective view of the insulation-displacement connector disclosed in Patent Document 1. An insulation-displacement connector 100 includes a housing and a plurality of insulation-displacement contacts 120 fixed to the housing. The housing includes a contact support portion 111 that supports the insulation-displacement contacts 120, a pair of fixing portions 112 and 113 that is mounted on the contact support portion 111 in such a manner as to sandwich part of the contact support portion 111 from each of an upper and a lower side, a plurality of shells 114 and 115 that covers exteriors of the contact support portion 111 and the pair of fixing portions 112 and 113, and covers 116 and 117. One end side of the cable can be mounted on each of the pair of fixing portions 112 and 113. Moreover, extending portions 140 and 141 extending in the mounting directions on the contact support portion 111 are provided to side surfaces of the pair of fixing portions 112 and 113. It is configured in such a manner that, when these cable holders are mounted on the contact support portion 111, these extending portions 140 and 141 are assembled to each other, and can come face to face with each other in a direction (an illustrated arrow "a" direction) along a lead-out direction of the cable at the fixing portions 112 and 113.

CITATION LIST

Patent Literature

Patent Document 1: JP-A-2003-171624

DISCLOSURE OF THE INVENTION

Problems to be Solved by the Invention

However, in the above insulation-displacement connector 100, it is not that the extending portions 140 and 141, for example, determine the positions of the fixing portions 112 and 113 with respect to the contact support portion 111 simply by assembling these extending portions 140 and 141 to each other. Therefore, when the fixing portions 112 and 113 are mounted on the contact support portion 111, or after the fixing portions 112 and 113 are mounted on the contact support portion 111 and before they are completely fixed, the positions of the fixing portions 112 and 113 with respect to the contact support portion 111 may be displaced. Especially since one end of the cable is mounted on the fixing portions 112 and 113, the positions of the fixing portions 112 and 113 with respect to the contact support portion 111 are easily displaced, for example, by accidentally pulling the cable.

The invention of the present application has been made to solve such a problem in the known technology, and an object thereof is to provide a cable connector in which cable holders such as the fixing portions 112 and 113 can maintain the positions with respect to a member such as the contact support portion 111 where the cable holders are mounted, before and after the mounting. Moreover, a configuration that facilitates the mounting is provided.

Solutions to the Problems

In order to solve the above problem, a cable connector according to one aspect of the present invention includes: a housing; and cable holders, and the cable holder allows one end of a cable to be mounted thereon, the cable holder has a cantilevered arm portion extending in a mounting direction of the cable holder on the housing, and at least part of the arm portion is capable of coming face to face with part of the housing in a direction along a lead-out direction of the cable from the cable holder at the time and after mounting of the cable holder on the housing.

According to the cable connector of the aspect, the part of the arm portion can come face to face with the part of the housing in the direction along the lead-out direction of the cable. Accordingly, when the cable holder is mounted on the housing, the movement of the cable holder with respect to the housing in the direction is regulated, and the cable holder can be easily positioned at a predetermined position of the housing. Moreover, the cable holder can be easily guided to the predetermined position of the housing, using the arm portion. Furthermore, even if an undesirable force occurs on the cable holder after the cable holder is mounted on the housing, the part of the arm portion faces the part of the housing in the direction along the lead-out direction of the cable. Accordingly, the cable holder can be maintained at the predetermined direction of the housing.

In the cable connector of the above aspect, it is preferable that the cable holder and the housing side be provided with a locking protruding portion and a corresponding locking portion, respectively, along the mounting direction, the cable holder have, along the mounting direction, a locking completion position where the locking protruding portion and the corresponding locking portion are already locked, and a temporary fixing position where the locking protruding portion and the corresponding locking portion are not yet locked, and at the temporary fixing position, the locking protruding portion collide with part of the housing side, and the cable holder be positioned in a state of being further apart in the mounting direction from the housing than at the locking completion position.

According to the cable connector of the aspect, the cable holder can be reliably mounted at the predetermined position of the housing in a more stable state by being brought into a temporary fixing state before actually performing locking.

In the cable connector of the above aspect, it is preferable that the locking protruding portion be provided to a part of the cable holder other than the arm portion.

According to the cable connector of the aspect, a plurality of the locking protruding portions is provided; accordingly, the cable holder can be more reliably locked to the housing.

In the cable connector of the above aspect, it is preferable that the locking protruding portion provided to the part other than the arm portion be spaced apart from the arm portion in the direction along the lead-out direction of the cable.

According to the cable connector of the aspect, the cable holder can be fixed to the housing in a more table state by being temporarily fixed at a position different in the lead-out direction of the cable.

In the cable connector of the above aspect, it is preferable that the locking protruding portion be provided near a free end of the elastically displaceable arm portion.

According to the cable connector of the aspect, the elasticity of the arm portion is used to enable locking.

In the cable connector of the above aspect, it is preferable that the cable holder have a protruding portion vertically arranged in the mounting direction of the cable holder on the housing, on a mounting side of the cable holder on the housing, and upon the cable holder being at the locking completion position, the protruding portion of one of the cable holders be placed in a state of being in close proximity to the other cable holder in a direction along the mounting direction.

According to the cable connector of the aspect, the protruding portion of one of the cable holders is placed in the state of being in close proximity to the other cable holder in such a manner as to be able to reach the other cable holder. Accordingly, damage to the cable holders can be reduced by preventing main bodies of the cable holders from coming excessively close to each other.

In the cable connector of the above aspect, it is preferable that the housing further have a terminal support that is capable of holding a terminal, and the corresponding locking portion be provided to the terminal support. According to the cable connector of the aspect, the terminal support is provided with the corresponding locking portion. Accordingly, the cable holder and the terminal support are locked and they can be fixed tightly to each other.

In the cable connector of the above aspect, it is preferable that the cable holders be formed in a pair having substantially the same size and shape. According to the cable connector of the aspect, the cable holders are formed in a pair having substantially the same size and shape. Accordingly, the management of components is facilitated, and the manufacturing process is also simplified.

Effects of the Invention

A cable connector is provided in which a cable holder can maintain the position of a member where the cable holder is mounted, before and after the mounting. Moreover, a configuration that facilitates the mounting is provided.

DESCRIPTION OF PREFERRED EMBODIMENT

A cable connector according to a preferred embodiment of the present invention is described hereinafter with reference to the accompanying drawings. Only the preferred embodiment of the present invention is illustrated here. However, naturally, this is not intended to limit the present invention.

Figure 1:
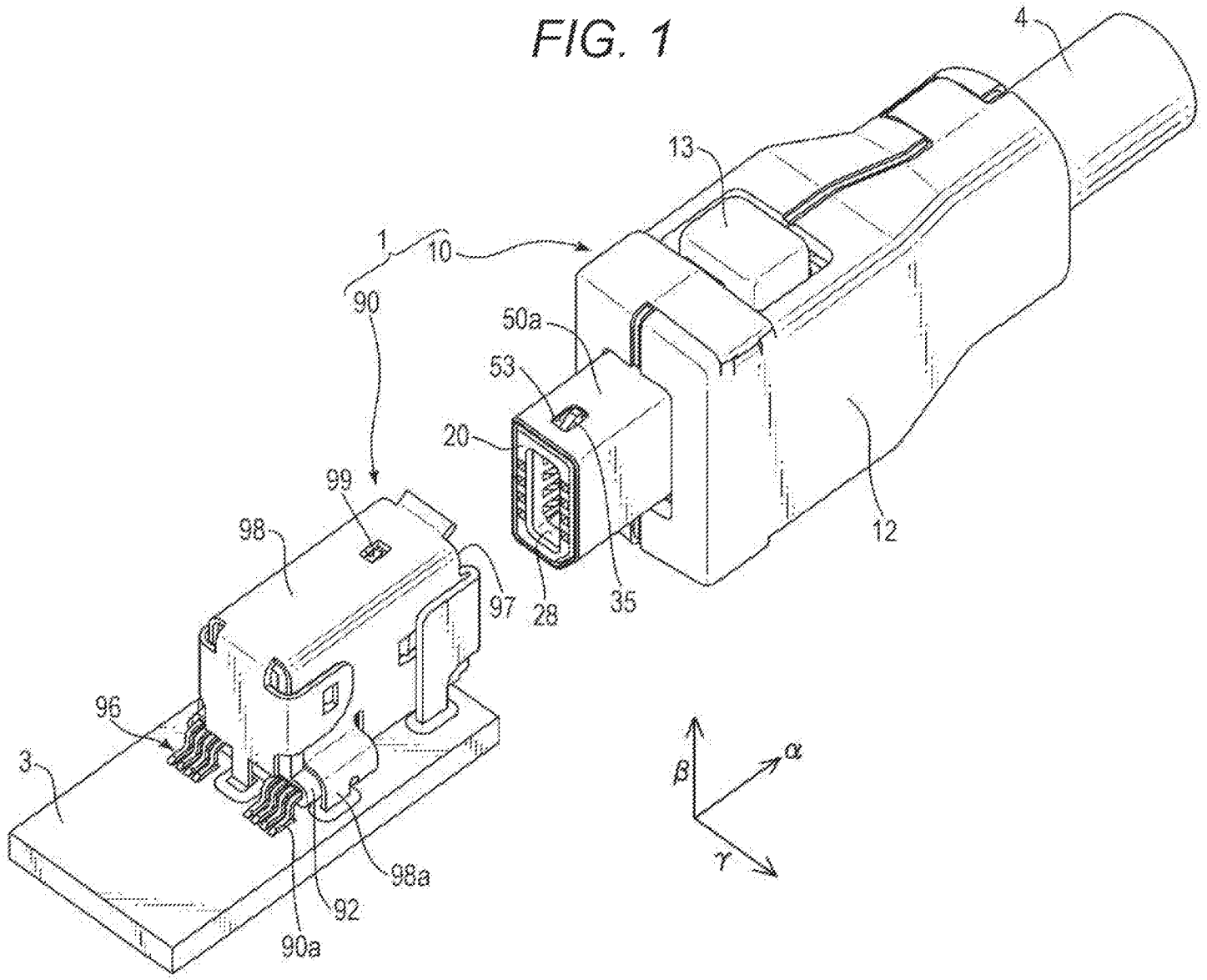
FIG. 1 is a perspective view of an electrical connector device using a cable connector according to the present invention.

FIG. 1 is a perspective view of an electrical connector device 1 using a cable connector 10 according to the present invention. The electrical connector device 1 includes a pair of the cable connector 10 and a counterpart connector 90. The counterpart connector 90 may be, for example, a connector of a board type that is connected to a board 3, but naturally is not limited to this. As long as the present invention can be employed, the counterpart connector 90 may be, for example, of a cable type as in the cable connector 10.

The cable connector 10 can be mated with and removed from the board connector 90 along an illustrated arrow "α" direction. In the description, for the sake of convenience, a description is given, letting a direction along the mating and removable directions of the cable connector 10 and the board connector 90 be the "α" direction, letting a height direction with respect to the board 3 of the board connector 90 be a "β" direction, letting a width direction of the board connector 90 be "γ".

The mating of the cable connector 10 and the board connector 90 can be locked using their shells. When the cable connector 10 and the board connector 90 are mated, a tapered mated portion 50*a* provided on the shell of the cable connector 10 is inserted into a substantially rectangular mating hole 97 provided on a front surface of the board connector 90, and lock portions protruding elastically from an upper side and a lower side of the distal end portion 50*a* of the cable connector 10, for example, lock protruding portions 35 protruding elastically from holes 53 of the shell, are fitted into locked portions provided on a ceiling portion and a base plate portion of a shell 98 of the board connector 90, for example, through-holes 99. As a result, the mating of the cable connector 10 and the board connector 90 is locked. In terms of the locking, the lock protruding portions 35 can be pulled out of the through-holes 99, by using, for example, a button 13 provided on the cable connector 10, or more specifically, by pushing the button 13 exposed from a hood 12 into the cable connector 10 along the "β" direction.

The board connector 90 mainly includes an insulating housing 92, terminals 96 that are held by the insulating housing 92 in a state of being partially exposed from the insulating housing 92, and the conductive shell 98 that covers an outer peripheral surface of the insulating housing 92.

The mating hole 97 that allows a part of the connector 10 to be mated is provided on a front surface of the insulating housing 92. Furthermore, a mating protrusion (not illustrated) that fits a mating recess 28 formed in a housing 20 of the connector 10 is provided in the mating hole 97. The terminals 96 are arranged on the mating protrusion in a state of being exposed on one end side. On the other hand, the other end side 90*a* of the terminals 96 is soldered onto the board 3. A part 98*a* of the shell 98 is fixed at a predetermined position of the board 3. Consequently, the shell 98 is connected to ground.

Figure 2:
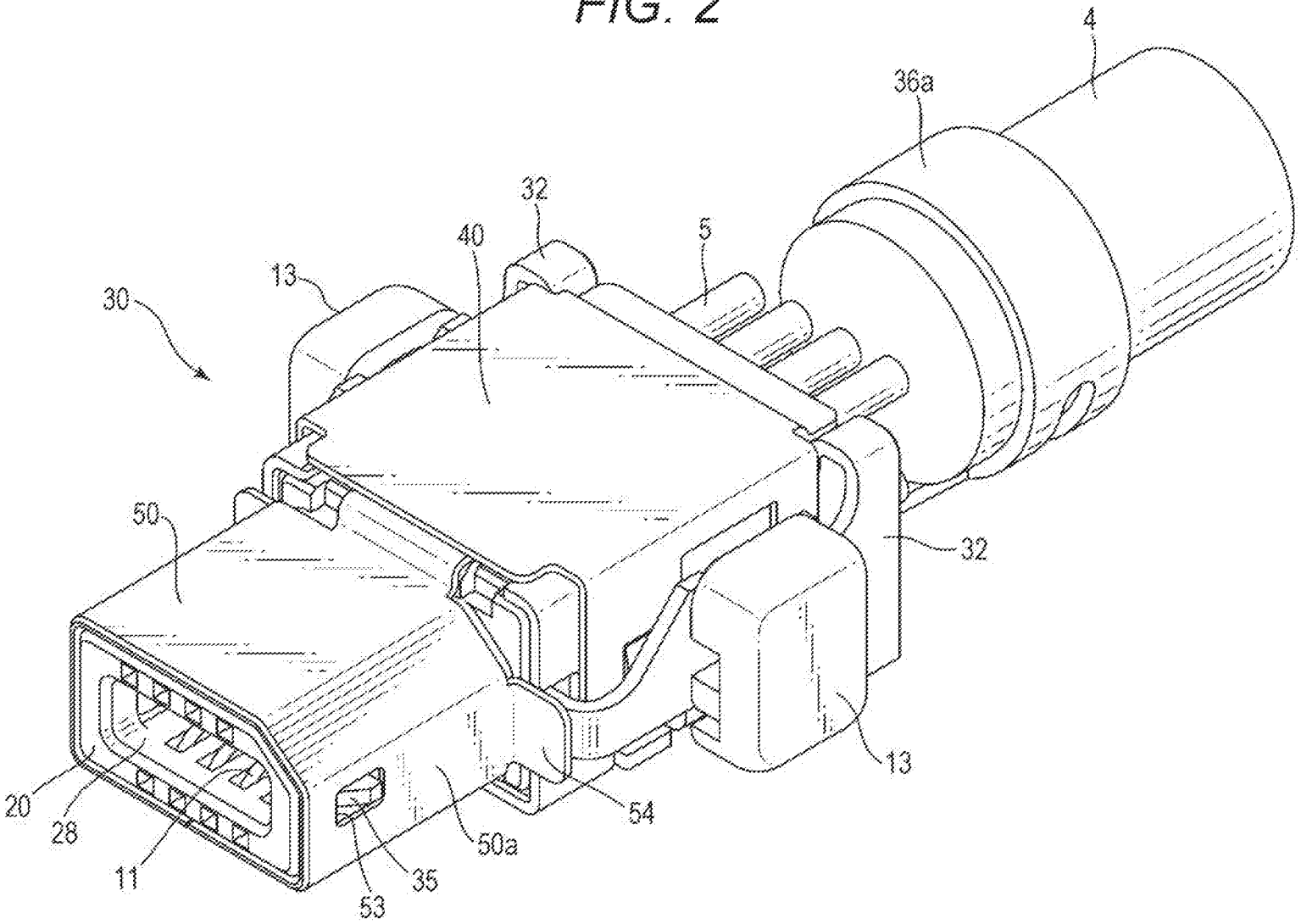
FIG. 2 is a perspective view illustrating an internal structure of the cable connector.
Figure 3:
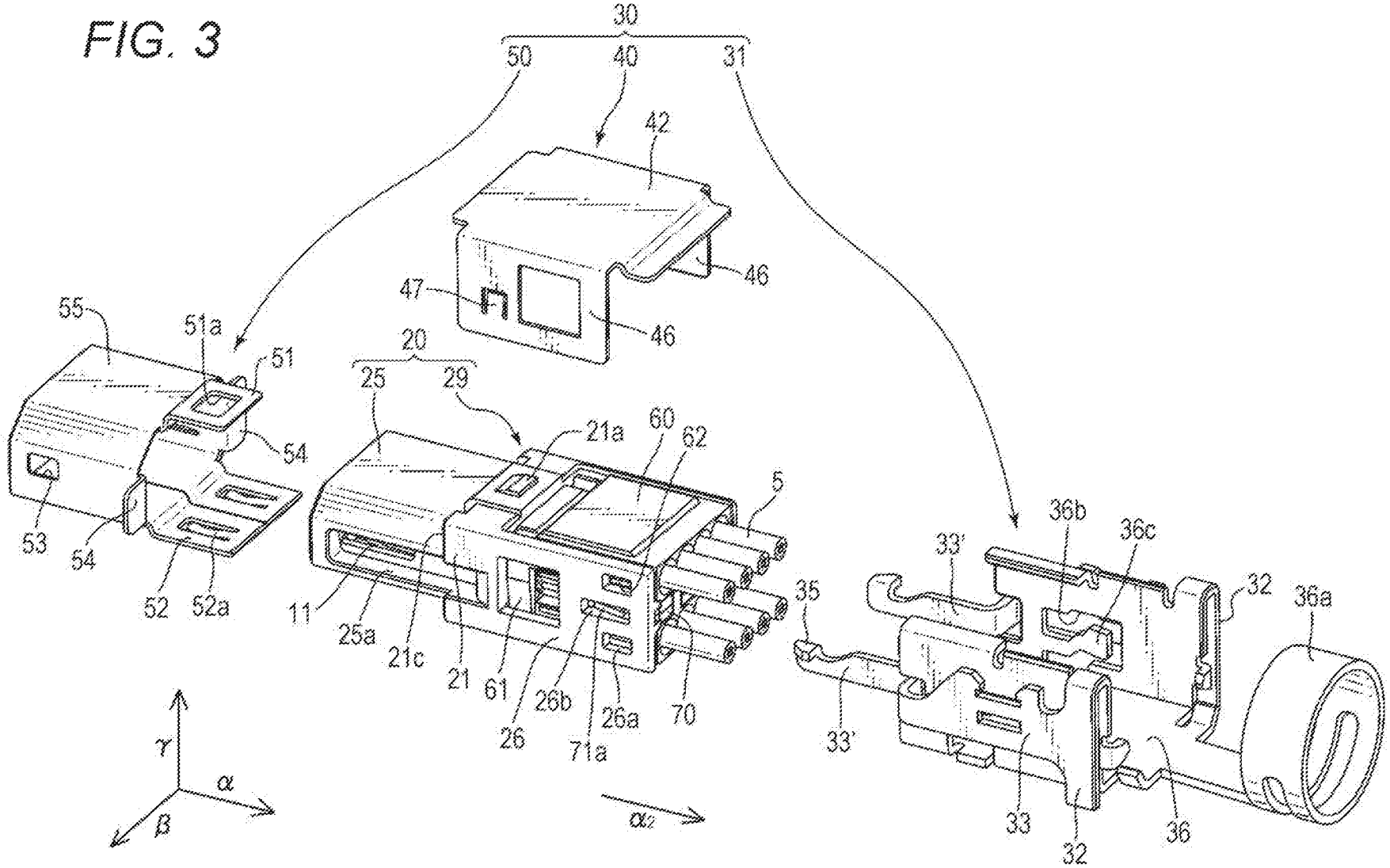
FIG. 3 is an exploded perspective view of the internal structure of FIG. 2.

FIG. 2 is a perspective view illustrating an internal structure of the cable connector 10. FIG. 3 is an exploded perspective view of the internal structure of FIG. 2. However, FIG. 2 is an illustration where the hood 12 and part of a sheath of the electrical cable 4, which are illustrated in FIG. 1, have been removed. FIG. 3 is an illustration where the sheath of the electrical cable 4 has been completely removed. The electrical cable 4 is assumed to include a plurality of twist pair cables 5 as an example. However, naturally, the present application is not limited to the twist pair cables 5. The cable connector 10 mainly includes the housing 20 formed of an insulating member such as resin, terminal supports 70 that support terminals 11, cable holders 60 that hold the cables 5, a conductive shell 30 that covers an outer peripheral surface of, for example, the housing 20, and the insulating hood 12 (refer to FIG. 1) that covers an outer peripheral surface of the shell 30.

The housing 20 includes a housing body 29 that is formed in a substantially cuboid shape by being complemented by the terminal supports 70 and the cable holders 60, and an inserted portion 25 protruding from the housing body 29 toward the mating side with the board connector 90 (refer to FIG. 1). The inserted portion 25 is a portion that is inserted into the mating hole 97 (refer to FIG. 1) of the board connector 90. The mating recess 28 into which the mating protrusion (not illustrated) provided in the mating hole 97 of the board connector 90 is inserted is formed in the inserted portion 25.

The shell 30 includes a main body shell 31, a plate-shaped shell 40, and a tubular shell 50. The plate-shaped shell 40 and the main body shell 31 mainly cover outer peripheral surfaces of side portions of, for example, the housing body 29. The plate-shaped shell 40 mainly covers outer peripheral surfaces of side portions of, for example, the housing body 29 that is not covered by the main body shell 31. The tubular shell 50 mainly covers outer peripheral surfaces of side portions of the inserted portion 25 with a slightly small diameter protruding from the housing body 29.

The main body shell 31 is formed by blanking one metal sheet and bending the blank, and has a substantially angular U-shape in cross section as a whole, and mainly includes a base 36, an elastic piece 33 extending frontward of the base 36, and a swaging portion 36*a* of the electrical cable 4 extending rearward of the base 36. A mounting piece 36*c* used to fix the cable 4 is provided in a rear part of the base 36. The base 36 and the elastic piece 33 are elastically connected at a rear end portion of the base 36 via a support portion 32 formed as a folded-over portion of a substantially U-shape in cross section. The elastic piece 33 has a free end on the mating side with the board connector 90. Furthermore, the lock protruding portion 35 used to lock to the board connector 90 is provided at the free end.

The plate-shaped shell 40 is formed by blanking one metal sheet and bending the blank as in the main body shell 31, and has a substantially angular U-shape in cross section as a whole, and includes a base 42 and two opposing plate portions 46. The plate-shaped shell 40 is mounted in such a manner as to sandwich the main body shell 31 between the two opposing plate portions 46. When the main body shell 31 is mounted, a tongue-shaped mounting piece 47 provided to the plate portion 46 is locked to an edge 36*b* of a mounting hole provided in the main body shell 31 and fixed to the edge 36*b*.

The tubular shell 50 is also formed by blanking one metal sheet and bending the blank as in the main body shell 31 and the plate-shaped shell 40, and has a substantially rectangular tubular shape as a whole, and includes a tubular base 55, mounting pieces 51 and 52 extending rearward from the base 55, and a pair of standing pieces 54 provided vertically outward on an edge of the base 55. The tubular shell 50 is mounted in such a manner as to insert the inserted portion 25 of the housing 20 into the tube of the base 55. At this point in time, the pair of standing pieces 54 is positioned with respect to the housing 20 by, for example, abutting a ring-shaped step surface 21*c* formed using a difference in diameter between the inserted portion 25 and the housing main body 29 of the housing 20. A hole 51*a* is provided on the mounting piece 51. When the tubular shell 50 is mounted, a locking protruding portion 21*a* provided to a base 21 of the housing 20 is fitted in the hole 51*a*. Moreover, locking portions 52*a* are provided to the mounting piece 52. The locking pieces 52*a* are locked at predetermined portions of the main body shell 31.

When the tubular shell 50 is mounted on the inserted portion 25, the lock protruding portion 35 provided at the free end of the elastic piece 33 of the main body shell 31 is brought into a state of elastically protruding from the hole 53 provided on the base 55 of the tubular shell 50. Moreover, at this point in time, a portion 33' on the free end side of the elastic piece 33 is placed in a gap formed between the tubular shell 50 and the inserted portion 25, and is protected by the tubular shell 50. It is preferable to provide an indentation 25*a* that releases the elastic piece 33 on a side surface of the inserted portion 25. Consequently, a portion where the portion 33' on the free end side of the elastic piece 33 is placed can be provided without increasing the size of the device.

Figure 4:
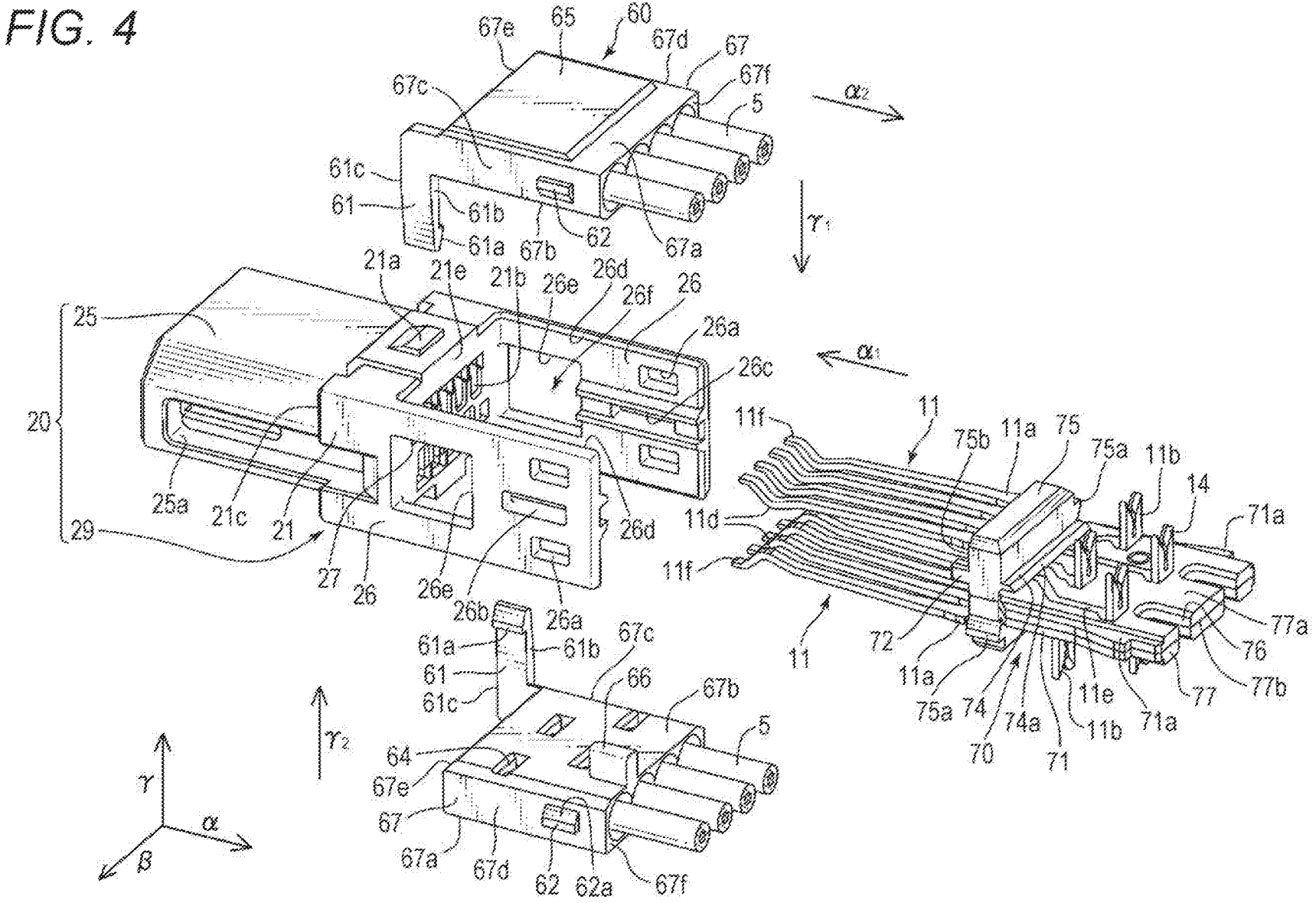
FIG. 4 is an exploded perspective view of, for example, a housing.
Figure 5:
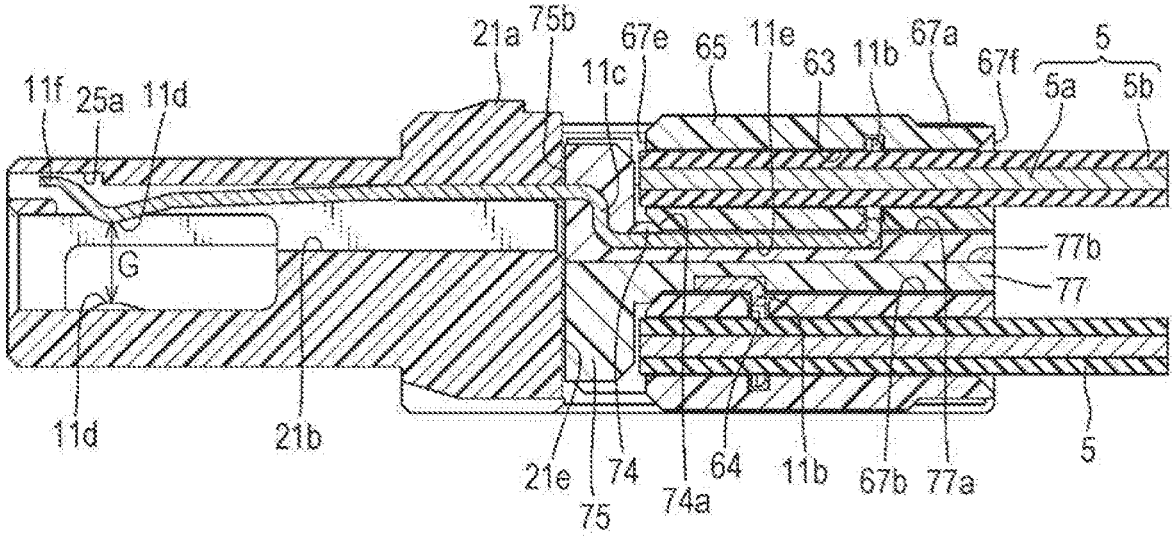
FIG. 5 is a vertical cross-sectional view of, for example, the housing.

FIG. 4 illustrates a perspective view of the housing 20 together with the terminal supports 70 and the cable holders 60, which have been removed from the housing 20. Furthermore, FIG. 5 illustrates a vertical cross-sectional view of the housing 20, and the terminal supports 70 and the cable holders 60, which have been mounted on the housing 20. FIG. 5 corresponds to a cross-sectional view taken along line E-E in FIG. 19 described below and, for the sake of convenience, is assumed to illustrate a state where the twist pair cables 5 have been connected. The housing body 29 includes the thick base 21, and two opposing plate-shaped side walls 26 extending rearward of the base 21, that is, opposite the inserted portion 25. The paired terminal supports 70 and the cable holders 60 paired likewise are placed in a space 26*f* formed between these plate-shaped side walls 26.

It is preferable that both of the paired terminal supports 70 have the same size and shape. Similarly, it is preferable that both of the paired cable holders 60 have the same size and shape. Having the same size and shape makes the management of components easy and also makes the manufacturing process simple. However, it is not necessarily required to have the same size and shape, and different sizes and shapes are also acceptable. Moreover, as long as the above effects can be obtained, having completely the same size and shape is not necessarily required, and having substantially the same size and shape is sufficient.

The terminal support 70 can support a plurality of the terminals 11 in cantilever fashion. The terminals 11 may be integrated by integral molding at the time of manufacture, or may be integrated with the terminal support 70 from the rear or above, using press-fitting or the like. In this example, a description is given assuming integral molding. Part of the terminal 11 is still exposed to the outside after being integrated. For example, a front part of the terminal 11, in other words, the vicinity of a distal end 11*f* of the terminal 11 extending to the base 21 side of the housing 20, and a rear part of the terminal 11, in other words, a cable insulation-displacement portion 11*b* to which the twist pair cable 5 is forced to be connected and a wiring portion 11*e* near the cable insulation-displacement portion 11*b*, are exposed. The distal end 11*f* side of the terminal 11 can be elastically displaced along the direction γ.

The terminal support 70 includes a plate-shaped main body 77. A vertically arranged portion 75 is provided on a top surface 77*a* of the main body 77, a lock projection 71*a* protruding outward is provided on each of the left and right side surfaces of the main body 77, and a notch 76 of a U-shape in plan view cut out inward is provided at a rear edge of the main body 77.

Figure 6:
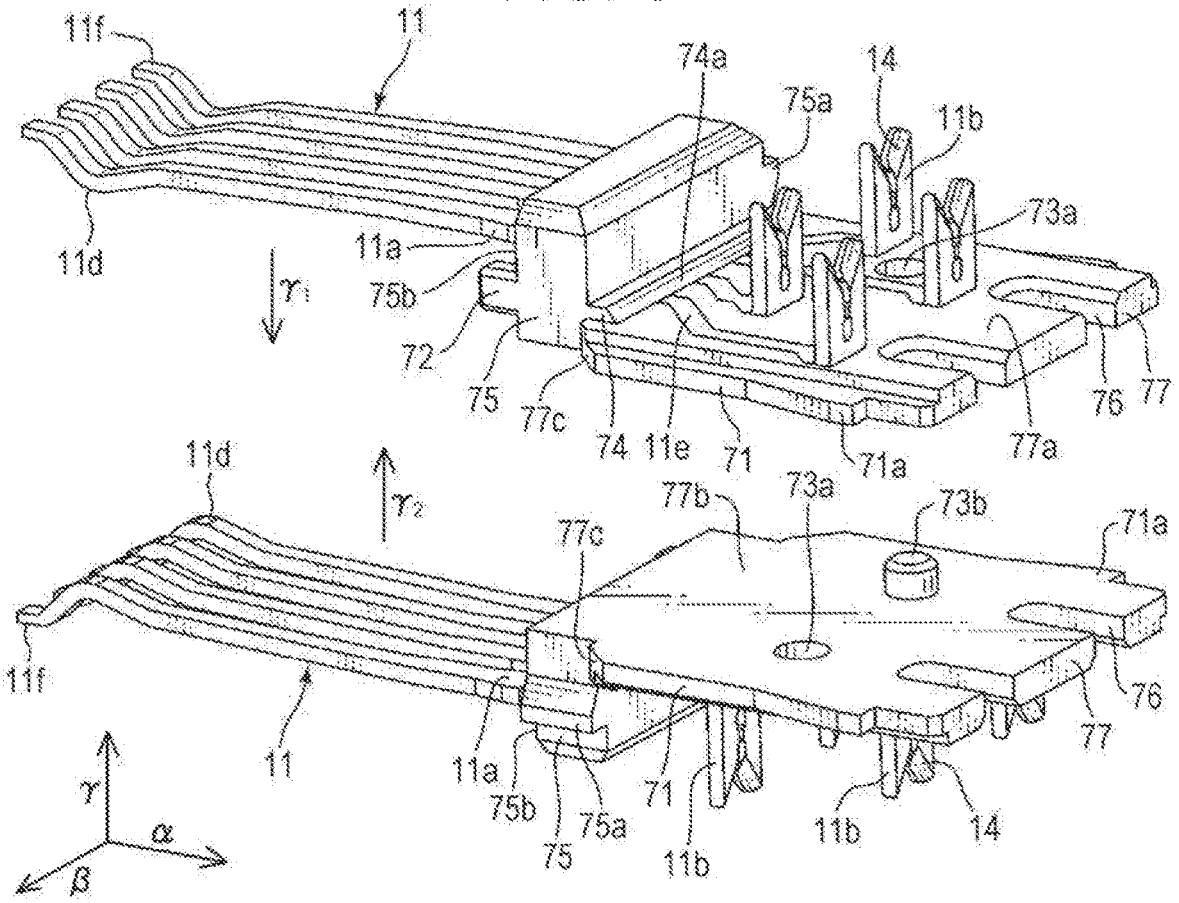
FIG. 6 is a perspective view of terminal supports before abutment.
Figure 7:
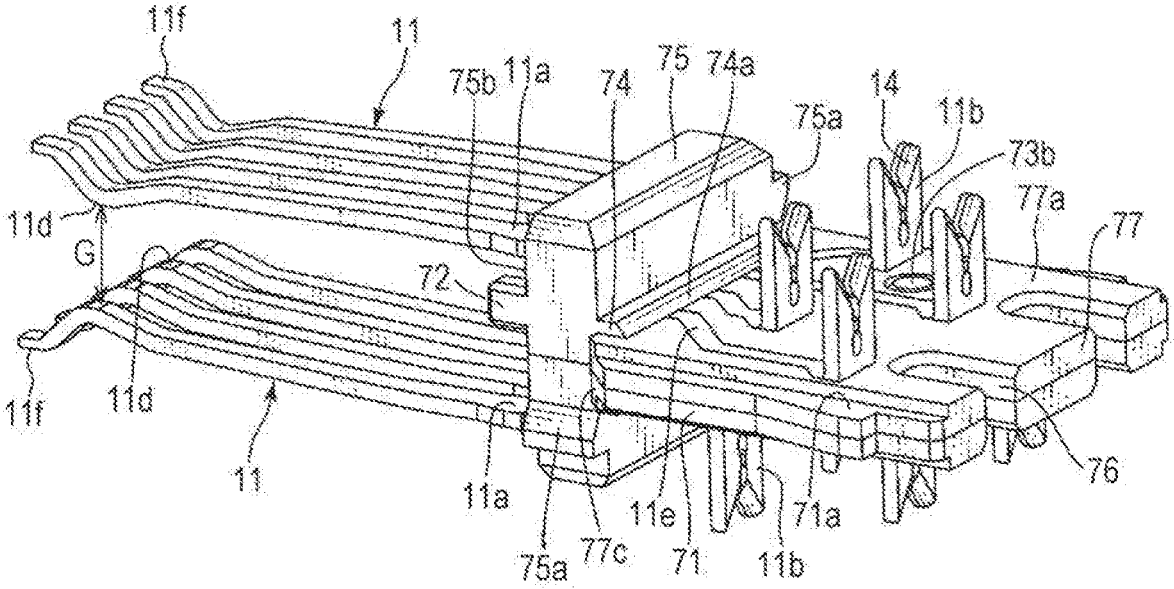
FIG. 7 is a perspective view of the terminal supports after abutment.
Figure 8:
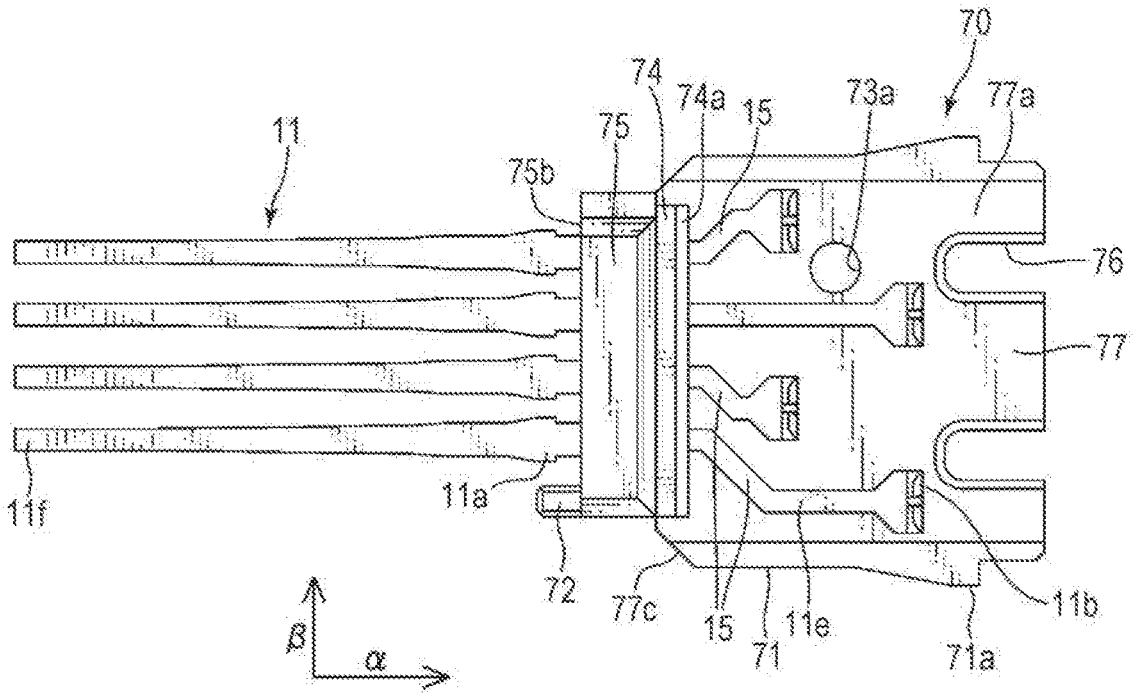
FIG. 8 is a plan view of the terminal support.
Figure 9:
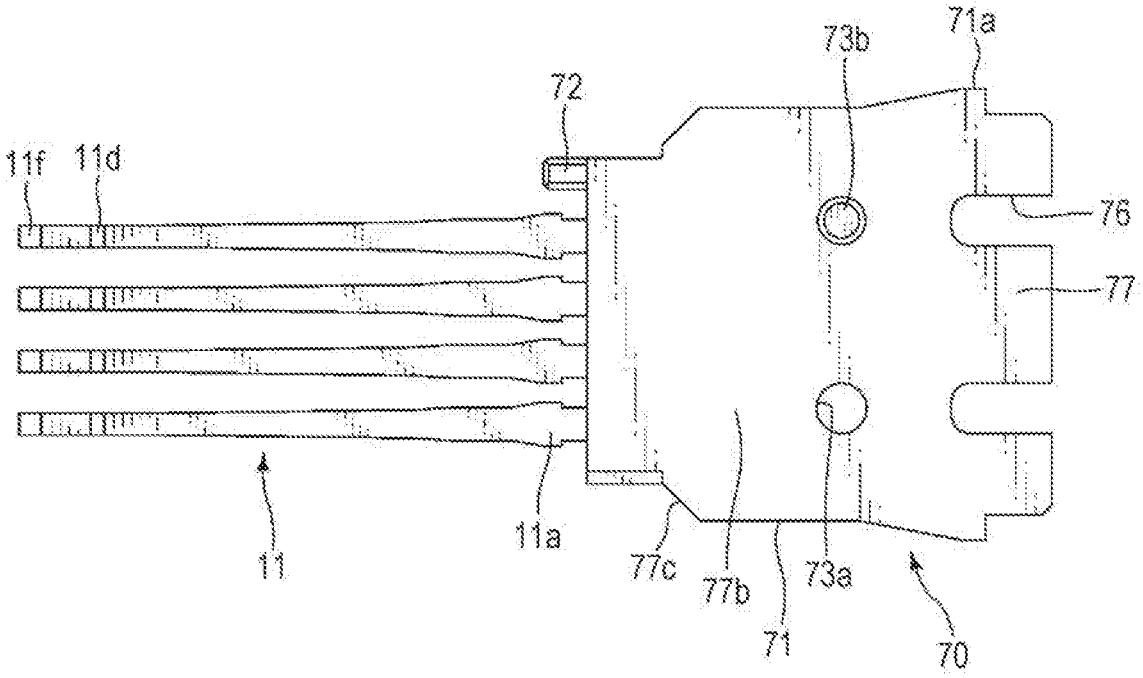
FIG. 9 is a bottom view of the terminal support.

At the time of assembly, firstly, the paired terminal supports 70 are abutted against each other in predetermined directions. FIGS. 6 and 7 illustrate a perspective view of the terminal supports 70 before the abutment and a perspective view of the terminal supports 70 after the abutment, respectively. Furthermore, FIGS. 8 and 9 illustrate a plan view of each terminal support 70 and a bottom view thereof, respectively.

As in this example, it is preferable that the paired terminal supports 70 be abutted on flat undersurfaces 77*b* thereof. The surfaces are made flat to enable abutment in a more stable state. However, if stable abutment can be performed, the surfaces are not necessarily made flat. Moreover, even if the surfaces are made flat, the surfaces are simply required to be substantially flat to a degree that allows stable abutment. The abutment is preferably performed in such a manner as to bring both of them into direct contact with each other as in this example. The direct contact allows the facilitation of the manufacture of the cable connector. However, direct contact is not necessarily required. A member may be sandwiched between them.

When the pair of terminal supports 70 is abutted against each other, the terminals 11 supported by the terminal supports 70 can form a gap "G" (refer to FIGS. 5 and 7) into which a contacted object, for example, the mating protrusion provided in the mating hole 97 of the board connector 90 (refer to FIG. 1), is inserted, between contacts 11*d* of the terminals 11. The gap "G" is formed in the direction "γ" along abutment directions "γ1" and "γ2" of the paired terminal supports 70.

A displacement prevention means may be provided to prevent the terminal supports 70 from being displaced after the abutment. For example, a through-hole 73*a* and a protruding portion 73*b* may be provided to each terminal support 70, and the pair of terminal supports 70 may be fitted at two points to each other in such a manner as to fit the protruding portion 73*b* of one terminal support into the through-hole 73*a* of the other terminal support. Naturally, displacement may be prevented not limited to by the through-hole 73*a* and the protruding portion 73*b* but in other methods.

The vertically arranged portions 75 are vertically arranged on the top surfaces "77*a*" being surfaces on sides opposite to abutment-side surfaces of the paired terminal supports 70, in other words, the undersurfaces 77*b* in the direction "γ" along the abutment directions "γ1" and "γ2", in the directions "γ2" and "γ1" opposite to the abutment directions "γ1" and "γ2". The terminal 11 is fixed by the vertically arranged portion 75 to the terminal support 70 near a base 11*c* formed in a substantially "S" shape. A locking protruding portion 75*a* that is locked to a corresponding locking portion (61*a*) provided to the cable holder 60 is provided on one of the left and right side surfaces of the vertically arranged portion 75.

The cable insulation-displacement portion 11*b* extends in the same direction as the vertically arranged portion 75, on the top surface 77*a* of the main body 77 of the terminal support 70. The cable insulation-displacement portions 11*b* of the plurality of terminals 11 are alternately placed along the direction α. A distal end portion 14 of the cable insulation-displacement portion 11*b* is bifurcated to form a groove. It is configured in such a manner that the twist pair cable 5 held by the cable holder 60 is pressed-fitted in the groove. An outer sheath 5*b* of the twist pair cable 5 press-fitted in the groove (refer to FIG. 5) is cut here. As a result, an internal core 5*a* (refer to FIG. 5) is caught in the groove to bring the cable 5 and the terminal 11 into conduction.

Each of the cable insulation-displacement portions 11*b* is coupled to the placement portion 11*e*. Pitch changing portions 15 may be provided to part or all of a plurality of the placement portions 11*e* (in this example, three of four terminals) to change the interval between the wiring portions 11*e* in a pitch direction "β" being an arrangement direction of the terminals 11 (refer to FIG. 8). These pitch changing portions 15 are provided; accordingly, the distance between the cable insulation-displacement portions 11*b* in the pitch direction "β" can be increased as compared to the distance between the distal ends 11*f*, and the pressure connection work can be facilitated.

It is preferable to provide an extending portion 74 extending from the vertically arranged portion 75, on the terminal support 70, to prevent, for example, a part of the core 5*a* exposed from the distal end (terminal) of the cable 5 held by the cable holder 60 from being shortened to an adjacent terminal. The extending portion 74 extends from the vertically arranged portion 75 toward the cable insulation-displacement portion 11*b* side within the top surface 77*a* of the terminal support 70, and covers at least part of the wiring portion 11*e* of the terminal 11 between the vertically arranged portion 75 and the cable insulation-displacement portion 11*b* in the direction "α" along a lead-out direction "α2" of the cable 45 from the cable holder 60. As well illustrated in FIG. 5, the extending portion 74 is preferable to extend to the cable insulation-displacement portion 11*b* side with respect to a front surface 67*e* of the cable holder 60. A taper 74*a* for preventing a collision with the cable holder 60 is formed at a distal end of the extending portion 74.

Figure 10:
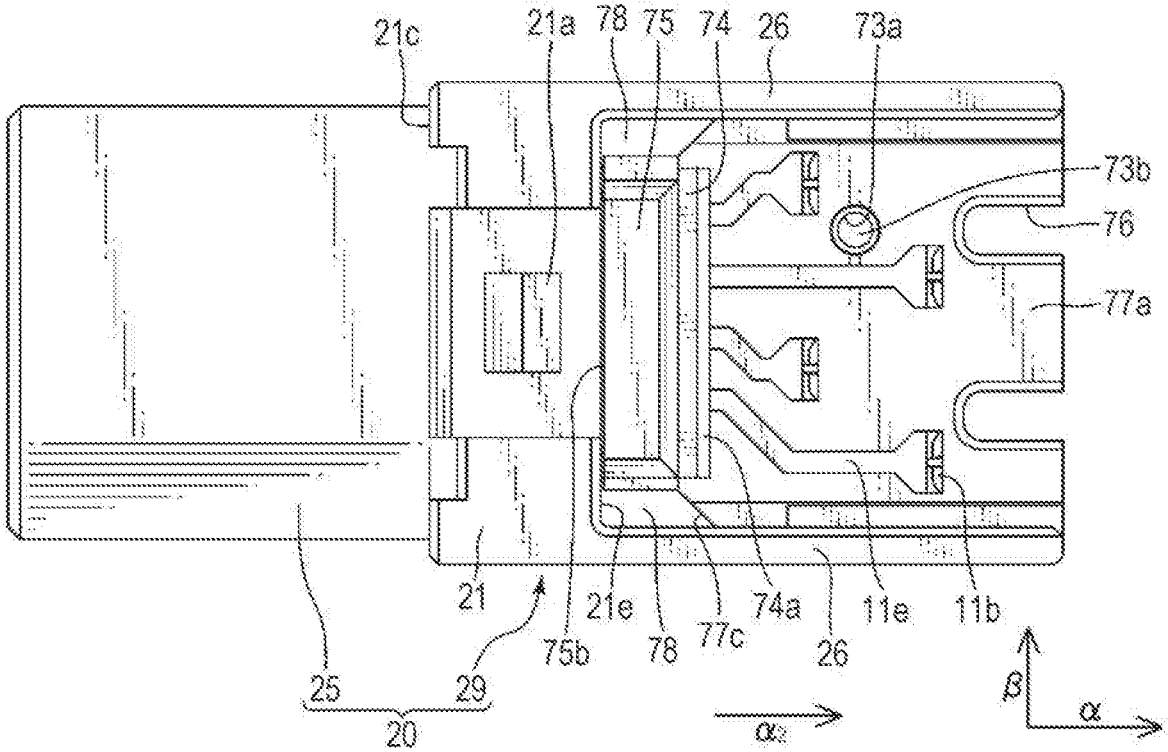
FIG. 10 is a plan view illustrating a state where the terminal supports have been mounted on the housing.
Figure 11:
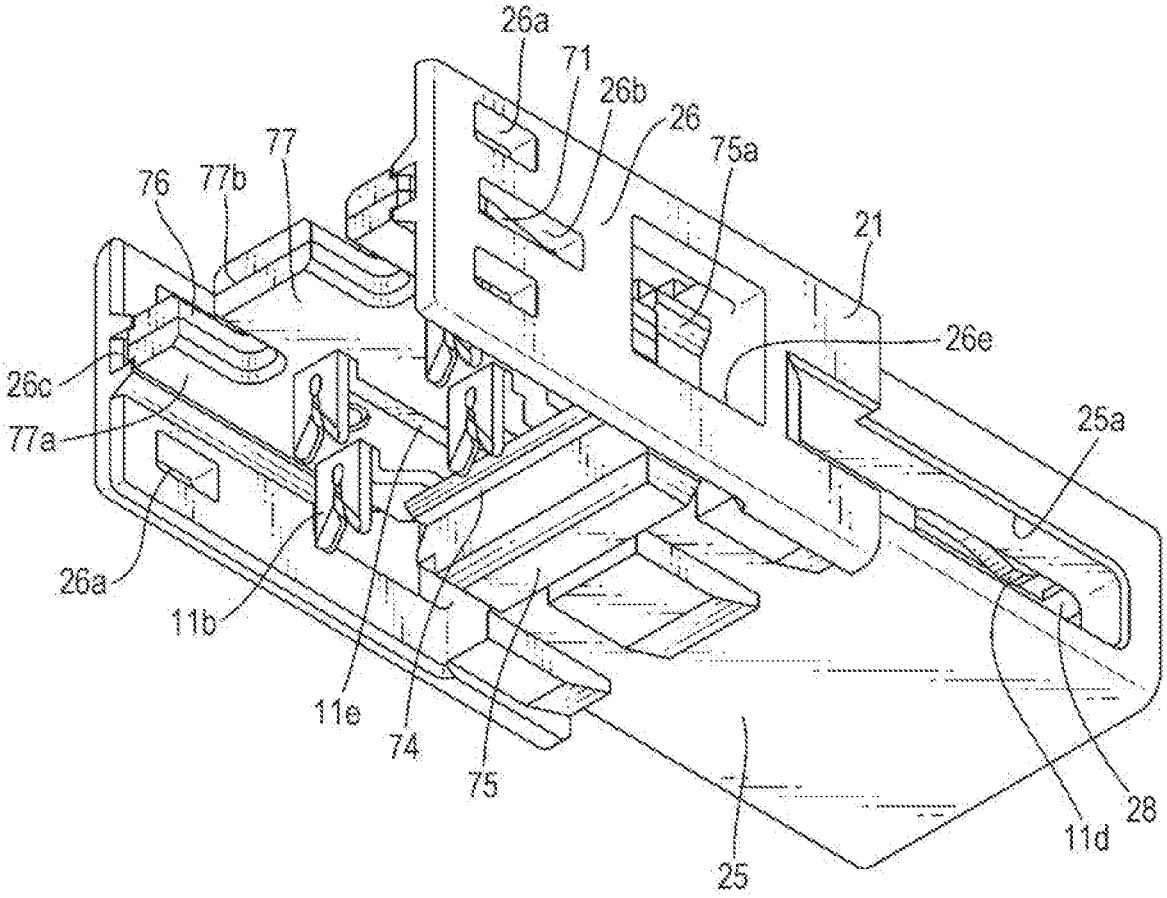
FIG. 11 is a perspective view illustrating the state where the terminal supports have been mounted on the housing.

A method for mounting the terminal supports 70 on the housing 20 is described with reference also to FIGS. 10 and 11. FIG. 10 is a plan view illustrating a state where the terminal supports 70 have been mounted on the housing 20. FIG. 11 is a perspective view of them when viewed from the bottom.

The pair of terminal supports 70 abutting each other is mounted on the housing 20 as they are, for example, parallel to the flat abutting surfaces that abut each other. The terminal supports 70 are guided into the housing 20 in a stable state by sliding left and right side surfaces 71 of the terminal supports 70 along guide grooves 26*c* provided on inner walls of the plate-shaped side walls 26. At this point in time, the pluralities of the terminals 11 supported by the terminal supports 70 are inserted into the inserted portion 25 through terminal insertion holes 21*b* (refer to FIG. 4) provided on an inner wall 21*e* of the base 21. At the time of completing the mounting, a press-fitted portion 11*a* of the terminal 11 is press-fitted in the vicinity of an entrance of the terminal insertion hole 21*b*. Moreover, a font outer wall 75*b* of the vertically arranged portion 70 of the terminal support 70 comes face to face with the inner wall 21*e* of the base 21. A positioning projection 72 provided to the terminal support 70 is fitted into a positioning hole 27 of the base 22. Furthermore, the lock protruding portions 71*a* provided on the side surfaces 71 of the terminal support 70 are fitted into lock holes 26*b* provided on the plate-shaped side walls 26 of the housing 20 to lock the terminal support 70 to the housing 20. The mounted state of the terminal supports 70 can also be checked through windows 26*e* provided on the plate-shaped side walls 26. In this manner, the flat surfaces are abutted against each other to perform mounting on the housing parallel to the flat surfaces; accordingly, the assembly can be made more suitable for mechanical production.

According to this configuration, in this manner, the paired terminal supports 70 that support the terminals 11 are simply abutted against each other, and mounted on the housing 20 as they are. Accordingly, the appropriate gap "G" can be formed between the contacts of the terminals 11. Therefore, it is possible to facilitate the manufacture of the electrical connector 10 and reduce the manufacturing cost. Especially when the abutting surfaces are made flat and the mounting is performed on the housing 20 parallel to the flat surfaces, the assembly can be made more suitable for mechanical production.

Figure 12:
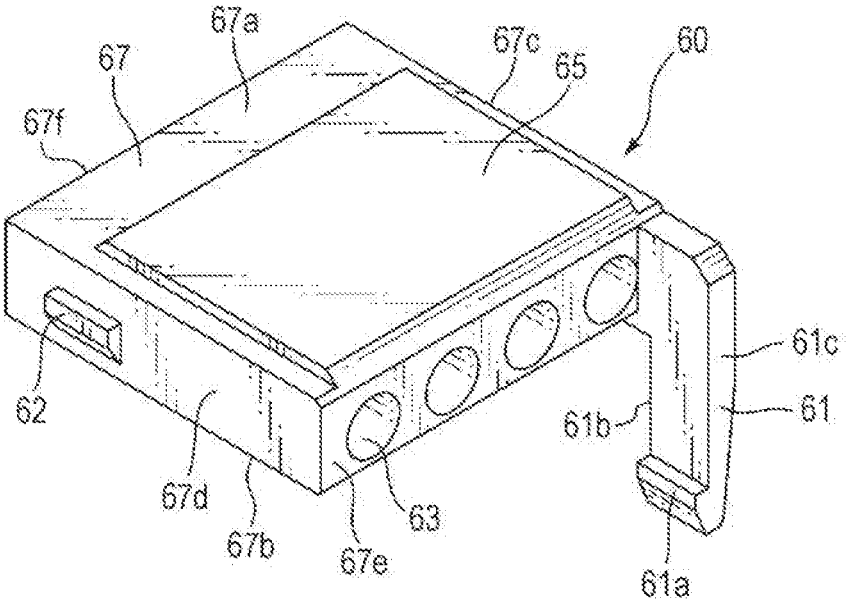
FIG. 12 is a perspective view of a cable holder when viewed from above.
Figure 13:
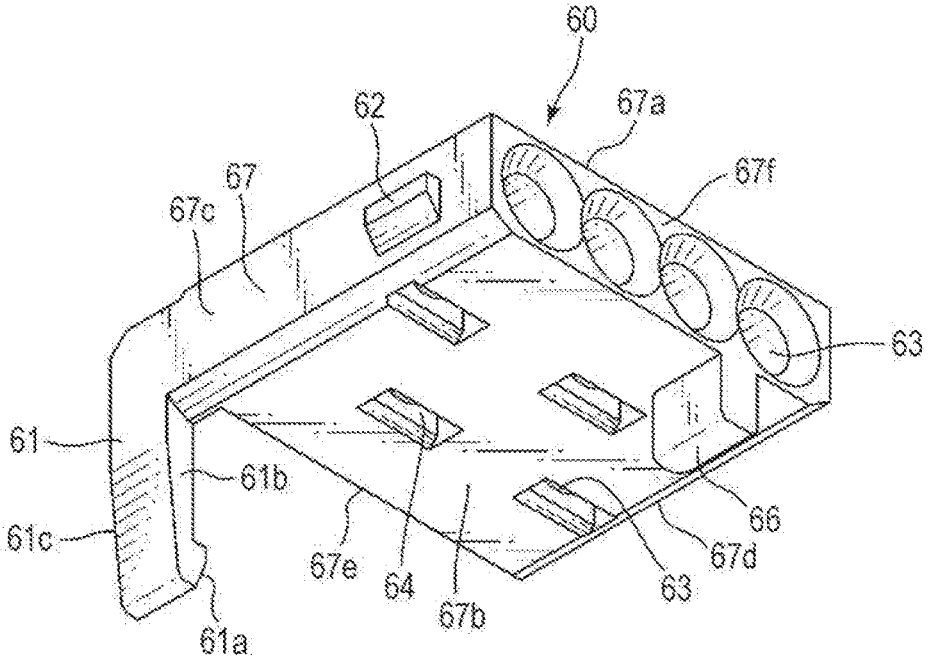
FIG. 13 is a perspective view of the cable holder when viewed from the bottom.

The configuration of the cable holder 60 is described with reference also to FIGS. 12 and 13. FIG. 12 is a perspective view of the cable holder 60 when viewed from above. FIG. 13 is a perspective view when viewed from the bottom. However, in FIGS. 12 and 13, the twist pair cables 5 illustrated in, for example, FIG. 4 are omitted.

The cable holder 60 mainly includes a substantially cuboid main body 67, and a cantilevered arm portion 61 extending from the main body 67 in the mounting directions "γ1" and "γ2" of the cable holders 60 on the housing 20. The arm portion 61 is coupled to the front surface 67*e* and one side surface 67*c* of the main body 67 on one end side opposite to the free end, and is provided in a state of being flush with the one side surface 67*c* of the main body 67 and in a state of protruding frontward of the front surface 67*e* of the main body 67. The arm portion 61 is preferable to be provided in such a manner as to be elastically displaced in a thickness direction. A plurality of through-holes 63 through which the terminal 11 is inserted is provided in the front-and-rear direction (the direction "α") in the main body 67. These through-holes 63 are used to mount one end side of the twist pair cables 5 on the cable holder 60. The mounted one end side of the twist pair cable goes from a rear surface 67*f* to the vicinity of the front side 67 side e of the main body 67 (refer to, for example, FIG. 5). The inner diameter of the through-hole 63 can be set to be substantially the same as or slightly smaller than the outer diameter of the cable 5. Consequently, an outer peripheral surface of the cable 5 is caught on an inner peripheral surface of the through-hole 63, which can prevent the cable 5 from accidentally coming out of the through-hole 63.

A locking protruding portion 62 that is locked in a locking hole 26*a* (refer to, for example, FIG. 11) provided on the plate-shaped side wall 26 of the housing 20 is provided on each of left and right side surfaces 67*c* and 67*d* of the main body 67. Moreover, the locking protruding portion 61*a* that is locked to the locking protruding portion 75*a* (refer to, for example, FIG. 11) provided on the vertically arranged portion 75 of the terminal support 70 is provided near the free end of the arm portion 61. The locking protruding portions 62 of the cable holder 60 and the locking holes 26*a* on the housing 20 side, and the locking protruding portion 61*a* of the cable holder 60 and the locking protruding portion 75*a* of the terminal support 70 are provided along the mounting directions "γ1" and "γ2" of the cable holders 60 on the housing 20. The cable holder 60 can be locked to the housing 20, using these locking means. In this manner, in the embodiment, the locking of the locking protruding portion 62 of the cable holder 60 and the locking hole 26*a* on the housing 20 side, and the locking of the locking protruding portion 61*a* of the cable holder 60 and the locking protruding portion 75*a* of the terminal support 70 allow the cable holder 60 to be locked at different points respectively to the housing 20 and the terminal support 70. The fixing of these three members (the housing 20, the terminal support 70, and the cable holder 60) can be strengthened. A plurality of locking means is not necessarily provided (in the embodiment, at two points). However, a plurality of them is provided to more reliably fix the cable holders 60 and the housing 20. Moreover, if a plurality of them is provided, the locking protruding portion 62 and the locking protruding portion 61*a*, and their corresponding locking hole 26*a* and locking protruding portion 75*a* are preferably spaced apart from each other in the direction "α" along the lead-out direction "α2" of the twist pair cable 5. They are spaced apart, and are locked at different positions in the lead-out direction of the cable; accordingly, the cable holder 60 can be fixed to the housing 20 in a more stable state.

An insertion hole 64 into which the cable insulation-displacement portion 11*b* of the terminal support 70 is inserted is provided on an undersurface 67*b* of the main body 67. The insertion hole 64 communicates with the through-hole 63 through which the twist pair cable 5 is inserted, and is configured in such a manner as to be capable of cutting the sheath 5*b* (refer to FIG. 5) of the twist pair cable 5 inserted through the through-hole 63, with the cable insulation-displacement portion 11*b* inserted through the through-hole 64, when the cable holder 60 is mounted on the housing 20.

Moreover, a protruding portion 66 that is fitted in the notch 76 provided on the terminal support 70 is provided on the undersurface 67*b* of the main body 67. The protruding portion 66 is vertically arranged on a surface on the mounting side of the cable holder 60 on the housing 20, that is, the undersurface 67*b*, in the mounting directions "γ1" and "γ2" of the cable holders 60 on the housing 20, that is, in the same direction as the arm portion 61.

A method for mounting the cable holders 60 on the housing 20 is described with reference also to FIGS. 14 to 19.

Figure 14:
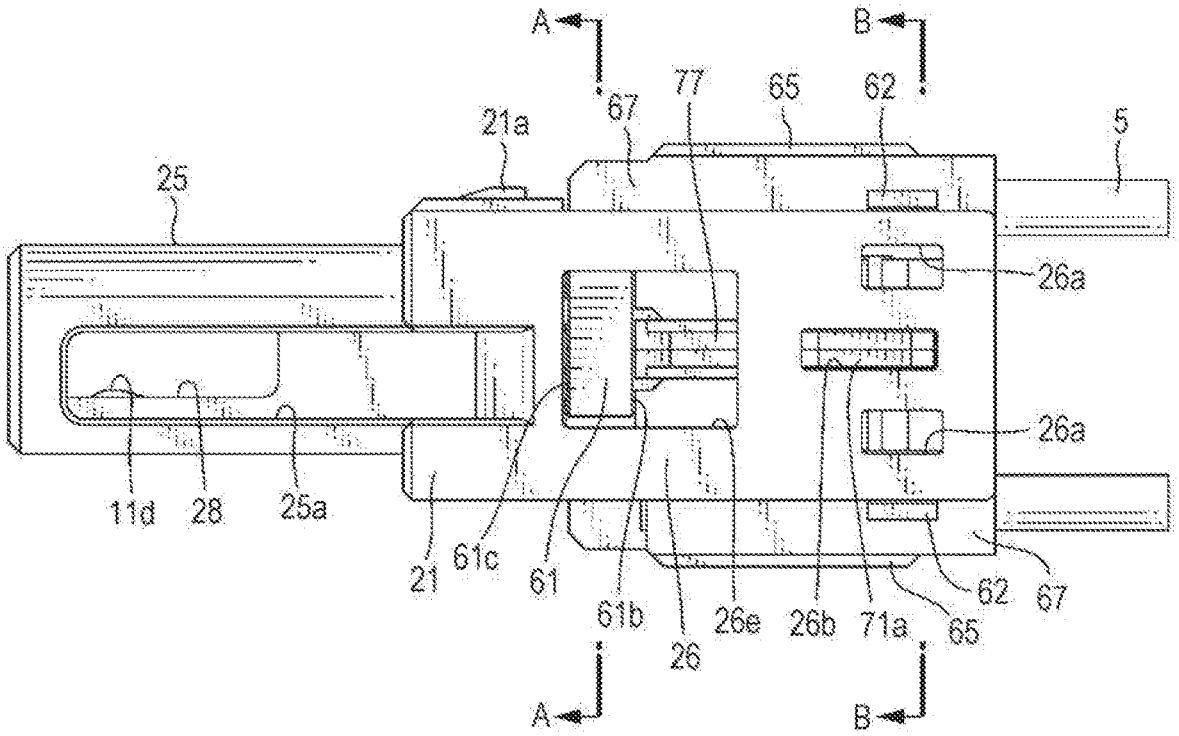
FIG. 14 is a side view of the housing at temporary fixing positions.
Figure 15:
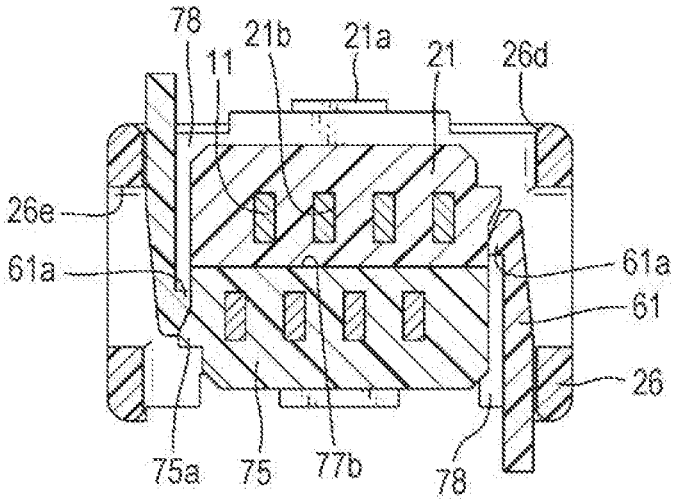
FIG. 15 is a cross-sectional view taken along line A-A in FIG. 14.
Figure 16:
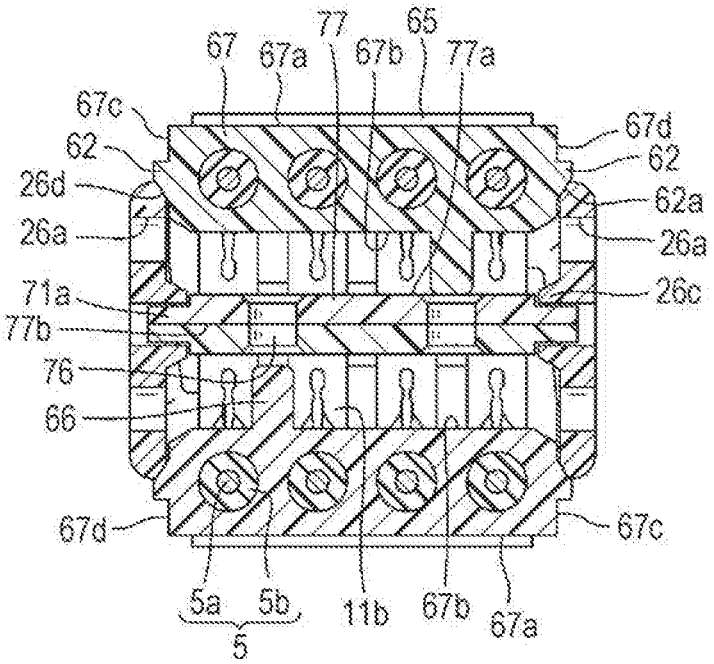
FIG. 16 is a cross-sectional view taken along line B-B in FIG. 14.

FIGS. 14 to 16 illustrate temporary fixing positions, in other words, a state where the locking protruding portions 61*a* and 62 of the cable holder 60 and the corresponding locking portions 75*a* and 26*a* on the housing 20 side are not yet locked. FIG. 14 is a side view of the housing 20 at the temporary fixing positions. FIG. 15 is a cross-sectional view taken along line A-A in FIG. 14. FIG. 16 is a cross-sectional view taken along line B-B in FIG. 14.

Figure 17:
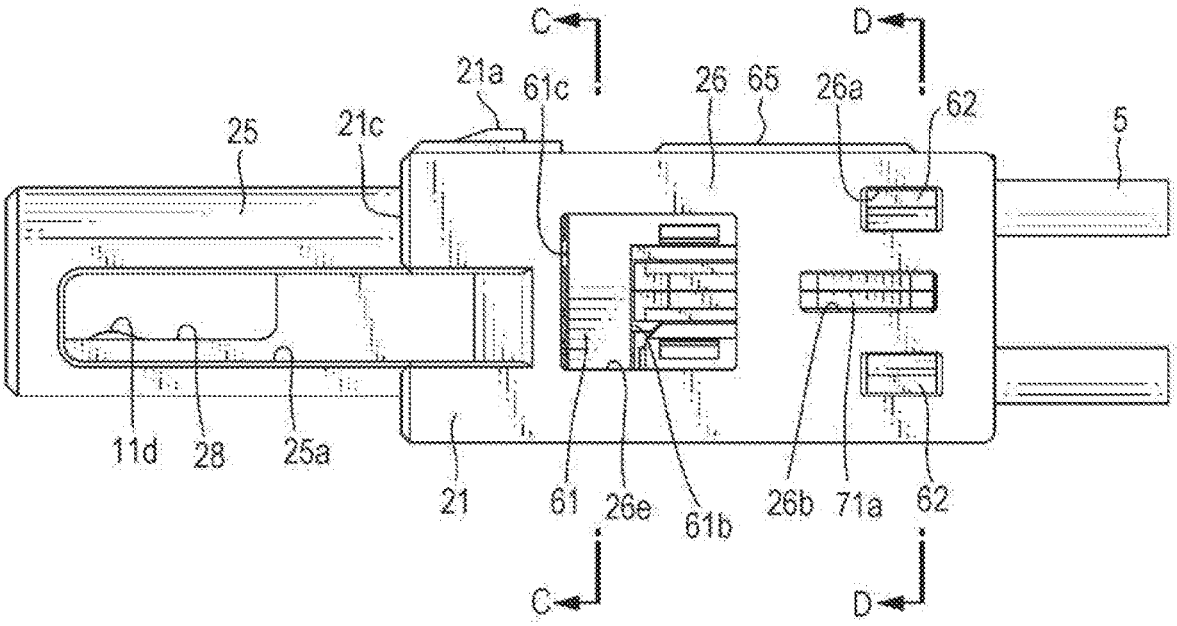
FIG. 17 is a side view of the housing at locking completion positions.
Figure 18:
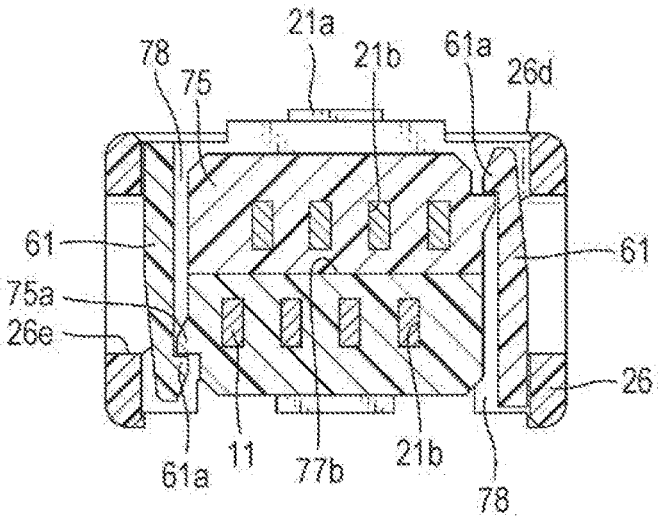
FIG. 18 is a cross-sectional view taken along line C-C in FIG. 17.
Figure 19:
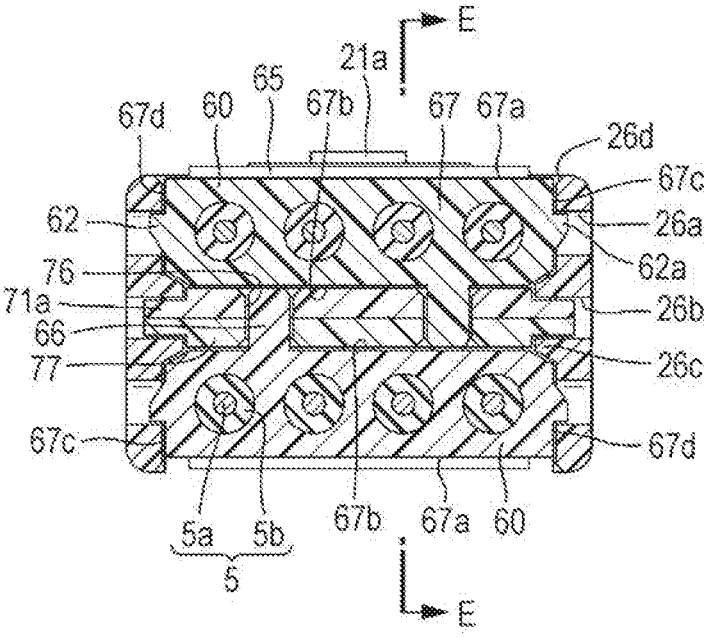
FIG. 19 is a cross-sectional view taken along line D-D in FIG. 17.

On the other hand, FIGS. 17 to 19 illustrate locking completion positions, in other words, a state where the locking protruding portions 61*a* and 62 of the cable holder 60 and the corresponding locking portions 75*a* and 26*a* on the housing 20 side have already been locked. FIG. 17 is a side view of the housing 20 at the locking completion positions. FIG. 18 is a cross-sectional view taken along line C-C in FIG. 17. FIG. 19 is a cross-sectional view taken along line D-D in FIG. 17.

The mounting of the cable holders 60 on the housing 20 and the terminal supports 70 is performed after the terminal supports 70 are mounted on the housing 20, in other words, is performed on the housing 20 in the state of FIGS. 10 and 11. The cable holders 60 are mounted in the abutment directions "γ1" and "γ2" on the top surfaces 77*a* of the terminal supports 70 mounted on the housing 20. In this manner, the abutment directions of the paired terminal supports 70 are made the same as the mounting directions of the cable holders 60 on the terminal supports 70, which makes it suitable for mechanical production to enable a reduction in manufacturing cost.

When the cable holders 60 are mounted on the terminal supports 70 and the housing 20, the cable holders 60 are positioned at the temporary fixing positions illustrated in FIGS. 14 to 16 before being actually locked and fixed. The locking protruding portion 61*a* and the taper 62*a* of the locking protruding portion 62, which are provided to the cable holder 60, collide respectively with the locking protruding portion 75*a* provided on the vertically arranged portion 75 of the terminal support 70 and an upper edge 26*d* of the plate-shaped side wall 26, which are part of the housing 20 side. As a result, the cable holders 60 are positioned in the mounting directions "γ1" and "γ2" in a state of being more apart from the housing 20 than at the locking completion positions. In this manner, the positions are determined to be the temporary fixing positions before locking is actually performed; accordingly, the cable holders 60 can be reliably mounted at predetermined positions of the housing 20 in a more stable state.

In addition, when the cable holders 60 are mounted on the terminal supports 70 and the housing 20, the arm portions 61 of the cable holders 60 are inserted into holes 78 (refer to FIG. 10) formed on the housing 20 side. The hole 78 is formed by the base 21, the plate-shaped side wall 26, and the terminal support 70, which configure the housing 20. When the arm portion 61 is inserted into the hole 78, at least part of the arm portion 61, for example, side surfaces 61*b* and 61*c* in the front-and-rear direction can come face to face with a taper 77*c* formed on the side surface 71 of the terminal support 70, and the inner wall 21*e* of the base 21, which are part of the housing 20, in the direction "α" along the lead-out direction "α2" of the cable 4 from the cable holder 60. As a result, when the cable holders 60 are mounted on the housing 20, it is possible to regulate the movement of the cable holders 60 with respect to the housing 20 in the "α" direction and easily position the cable holders 60 at the predetermined positions of the housing 20. Moreover, it is also possible to easily guide the cable holders 60 to the predetermined positions of the housing 20, using the arm portions 61. Furthermore, also if an undesirable force occurs on the cable holder 60 after the cable holder 60 is mounted on the housing 20, the arm portion 61 faces part of the housing 20 in the direction "α" along the lead-out direction of the cable 4; accordingly, the cable holder 60 can be maintained at the predetermined position of the housing 20.

After being positioned at the temporary fixing positions illustrated in FIGS. 14 to 16, the cable holders 60 can be mounted together on, for example, the housing 20 by, for example, temporarily applying the force to simultaneously sandwich top surfaces 67*a* of the pair of opposing cable holders 60 with fingertips, a jig, or the like. It is preferable to provide a step portion 65 protruding upward on the top surface 67*a* of the cable holder 60 in such a manner as to more reliably allow a fingertip or the like to touch the top surface 67*a* of the cable holder 60. The electrical connector targeted in this case may have the top surface 67*a* with an area of, at most, approximately one square cm. In a case of such a small one, providing the step portion 65 is especially effective.

As illustrated in FIGS. 17 to 19, at the locking completion position, the locking protruding portion 61*a* provided to the arm portion 61 of the cable holder 60 moves over and is locked to the locking protruding portion 75*a* provided to the vertically arranged portion 75 of the terminal support 70. Moreover, the locking protruding portions 62 provided on the side surfaces 67*c* and 67*d* of the main body 67 of the cable holder 60 move over the upper edges 26*d* of the plate-shaped side walls 26 of the housing 20, and are fitted in the locking holes 26*a*. Moreover, at this point in time, the protruding portion 66 provided on the cable holder 60 is placed through the notch 76 provided to the terminal support 70 in a state of being in close proximity to the counterpart cable holder.

When the cable holders 60 shift from the temporary fixing positions illustrated in FIGS. 14 to 16 to the locking completions position illustrated in FIGS. 17 and 19, the twist pair cables 5 held by the cable holders 60 can be connected to the cable insulation-displacement portions 11*b* of the terminals 11, using the force that has been applied to mount the cable holders 60 on the housing 20.

When an excessive force is applied to the cable holders 60 at the time of the shift, the cable holders 60 may be brought close to each other more than necessary and the connector 10 may be broken. However, if such a force is applied, the protruding portion 66 provided on the cable holder 60 collides first with the counterpart cable holder 60 before the cable holder 60 is pressed against the terminal holder 70. Accordingly, damage to the cable holder 60 can be reduced. In the embodiment, the protruding portion 66 is located on the lead-out (the arrow "α2") side of the cable 5 to which an excessive force tends to be applied, and further is located at two points in the arrangement direction (the arrow "β") of the cable 5; therefore, it is highly effective.

Figure 20:
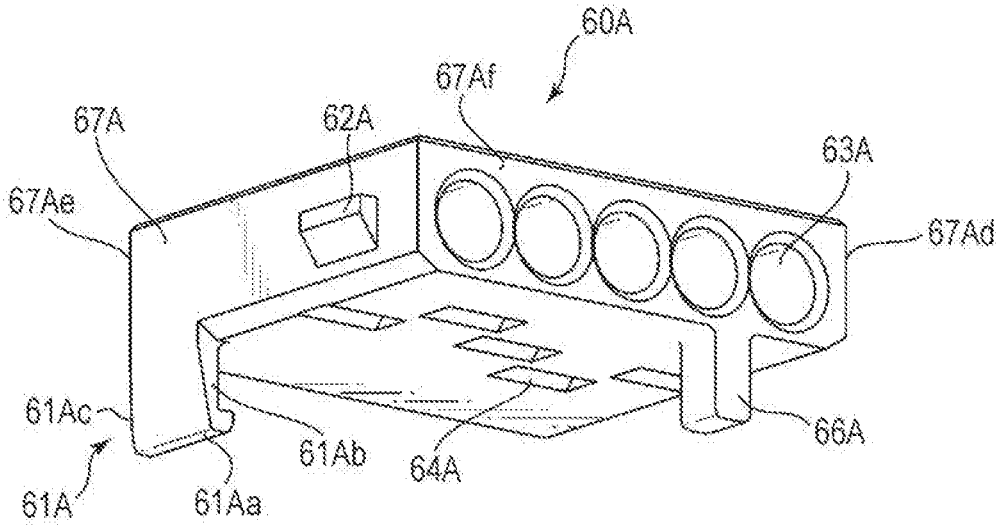
FIG. 20 is a perspective view of the cable holder according to a modification when viewed from a cable mounting side.
Figure 21:
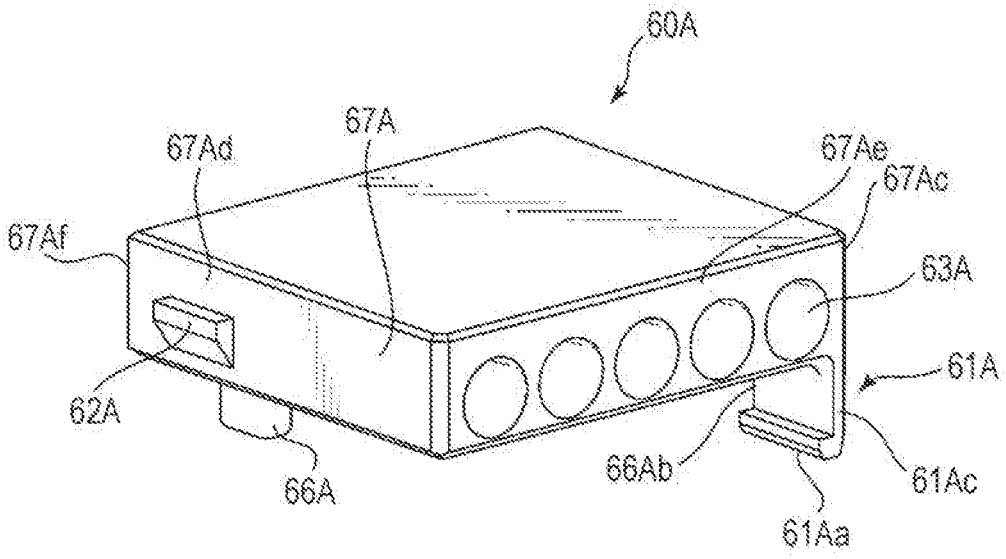
FIG. 21 is a perspective view of the cable holder according to the modification when viewed from a side opposite to the cable mounting side.

A modification of the cable holder is illustrated in FIGS. 20 and 21. These drawings are views corresponding to the perspective views of the cable holder 60 illustrated in FIGS. 12 and 13. FIG. 20 is a perspective view of a cable holder 60A according to the modification when viewed from the cable mounting side. FIG. 21 is a perspective view when viewed from a side opposite to the cable mounting side. In these drawings, the letter "A" is added to reference signs of members corresponding to the members of the cable holder 60 described with reference to, for example, FIG. 1. In the following description, points that are not particularly described can be considered to be similar to those of the cable holder 60.

A basic configuration of the cable holder 60A is the same as the cable holder 60. The cable holder 60A is mainly different from the cable holder 60 in the position and length of an arm portion 61A.

In terms of the position, the arm portion 61 of the cable holder 60 described with reference to, for example, FIG. 1 is provided in the state of protruding forward of the front surface 67*e* of the main body 67, whereas an arm portion 61A of the cable holder 60A is provided from the same position as a front surface 67Ae of a main body 67A to the rear along the penetrating direction of a through-hole 63A. Therefore, the cable holder 60A does not have a part protruding from the front surface 67Ae. When the cables are mounted in the cable holder 60A, the cables inserted through the through-holes 63A are normally brought into a state of protruding from the front surface 67Ae of the through-holes 63A in some degree, and these protruding portions are cut to be aligned with the end surface. However, when these protruding portions are cut, if the arm portion protrudes forward beyond the front surface 67Ae, the arm portion may be cut together with the cables. In contrast, if the arm portion 61A is provided from the same position as the front surface 67Ae of the main body 67A to the rear as in the cable holder 60A, the risk of cutting the arm portion can be eliminated. As is clear from the above, it is sufficient if the arm portion 61A does not protrude forward of the front surface 67Ae, and the arm portion 61A is not necessarily required to reach the same position as the front surface 67Ae.

Moreover, in terms of the length, the arm portion 61A of the cable holder 60A is set to be shorter than the arm portion 60 of the cable holder 60 described with reference to, for example, FIG. 1. The length of the arm portion 61A is set to be shorter, for example, substantially the same as a protruding portion 66A; accordingly, the opportunity of entanglement of the cable holders due to the arm portion 61A is reduced, and the handling of the cable holder is facilitated.

Figure 22:
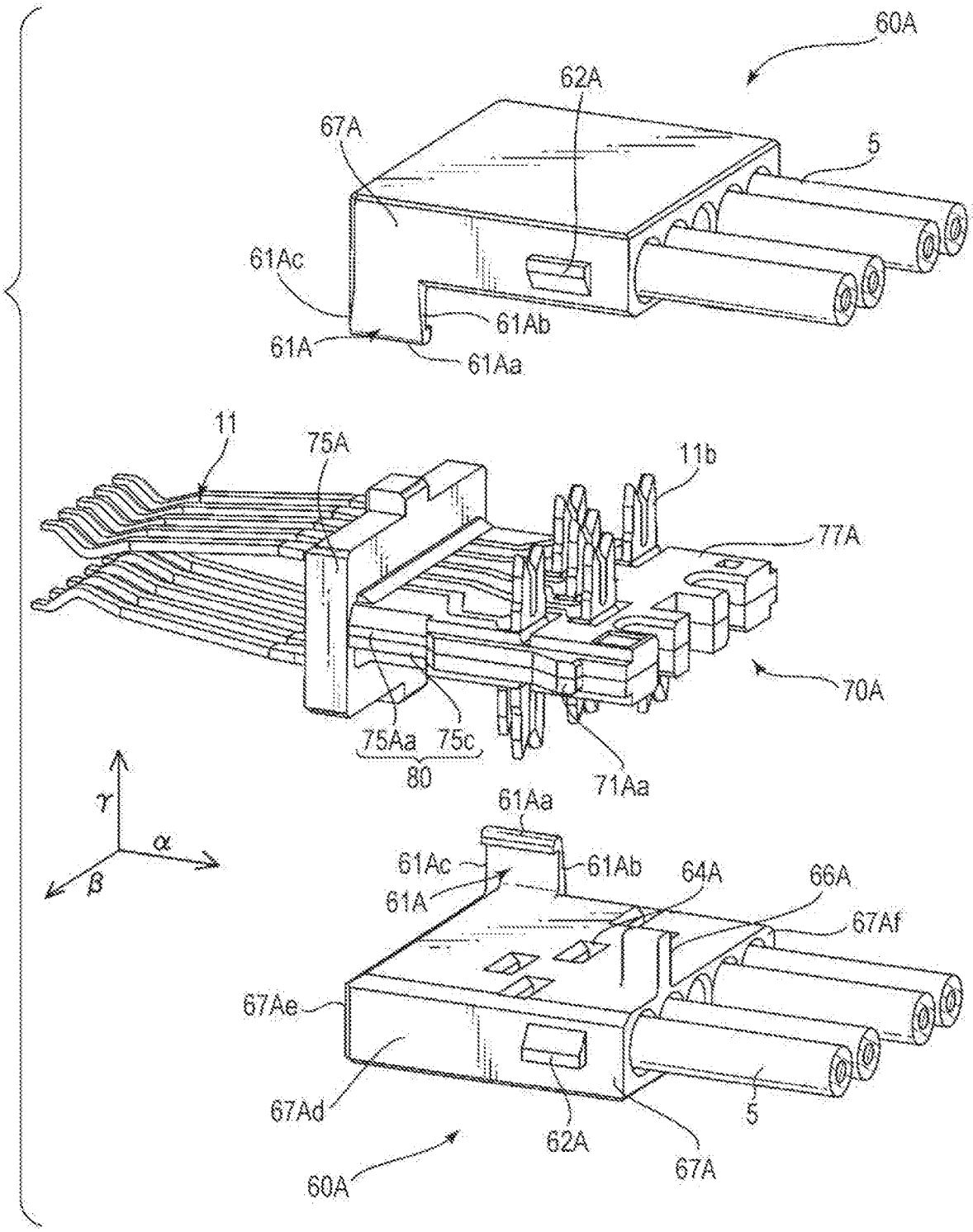
FIG. 22 is an exploded perspective view illustrating a modification of the terminal supports together with the cable holders.
Figure 23:
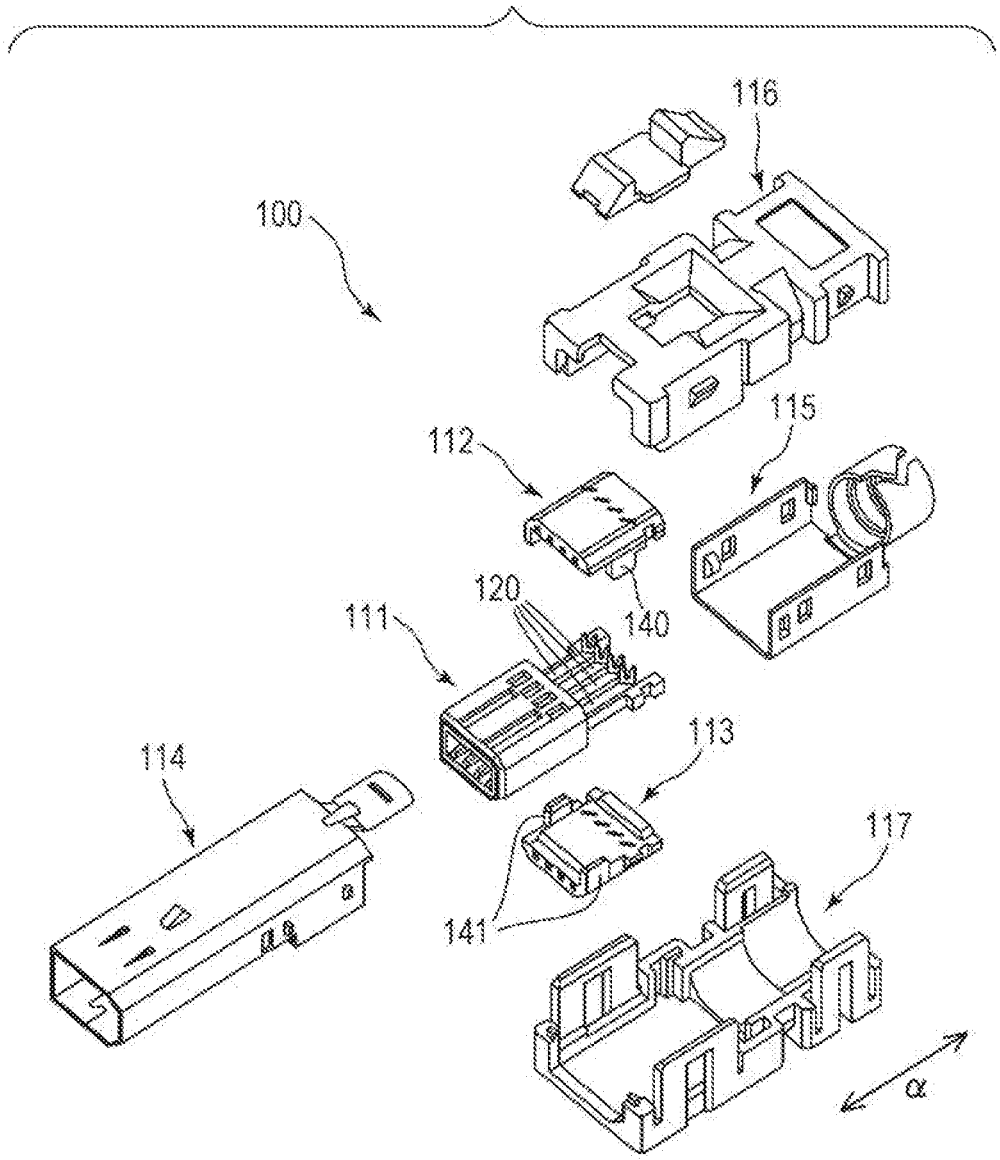
FIG. 23 is a perspective view illustrating a known example.

FIG. 22 is a view corresponding to the exploded perspective view of FIG. 4, and is a view illustrating a modification of terminal supports 70A in response to the change in the shape of the cable holder 60A. However, the housing is omitted here. In the drawing, the letter "A" is added to reference signs of members corresponding to the members of the terminal support 70 described with reference to, for example, FIG. 1. In the following description, points that are not particularly described can be considered to be similar to those of the terminal support 70.

The arm portion 61A of the cable holder 60A, or especially a locking protruding portion 61Aa of the arm portion 61A, is locked to a locking protruding portion 80 of the terminal support 70A. Changes are also added to the position and target to provide the locking protruding portion 80 in accordance with the change in the position of the arm portion 61A of the cable holder 60A.

In terms of the position, the locking protruding portion 80 is displaced slightly further to the rear than the locking protruding portion 75*a* of the terminal support 70 in the cable axis direction "α". Moreover, the locking protruding portion 80 is provided at a position closer to the center of the housing than the locking protruding portion 75 of the terminal support 70 described with reference to, for example, FIG. 1, in accordance with the change in the length of the arm portion 61A of the cable holder 60A.

In terms of the target, the locking protruding portion 75*a* of the terminal support 70 illustrated in, for example, FIG. 1 is provided on the box-shaped vertically arranged portion 75, whereas the locking protruding portion 80 is provided on a plate-shaped main body 77A. The plate-shaped main body 77A of lower strength than the box-shaped vertically arranged portion 75 is provided with the locking protruding portion 80. Accordingly, for the purpose of increasing strength, the locking protruding portion 80 is configured including at least a locking protruding portion forming part 75Aa and a locking protruding portion forming part 75*c*, which are paired. They are combined to ensure strength.

The present invention is not limited to the above-mentioned embodiment, and other various modifications can be made. For example, the terminal supports 70 have been described assuming to be provided as separate bodies from the housing 20. However, the terminal supports 70 may be integrally formed with the housing 20. Moreover, for example, the above embodiment illustrates the example of being applied to the electrical cable. However, the configuration of the present invention can also be applied to, for example, an optical fiber cable. In this manner, the drawings and description of the present application are simply exemplifications, and are not limited to them.

1 Electrical connector device
4 Electrical cable
5 Twist pair cable
10 Cable connector
11 Terminal
20 Insulating housing
21 Base
28 Mating recess
30 Conductive shell
31 Main body shell
40 Plate-shaped shell
50 Tubular shell
60 Cable holder
61 Arm
61*a* Locking protruding portion
61*b* Rear surface
61*c* Front surface
62 Locking protruding portion
70 Terminal support
74 Extending portion
75 Vertically arranged portion (fixing portion)
78 Hole
90 Board connector

The invention claimed is:

1. A cable connector comprising:

a housing; and cable holders, wherein one of the cable holders allows one end side of a cable to be mounted thereon, the one of the cable holders includes a single cantilevered arm portion extending in a mounting direction of the one of the cable holders on the housing, at least part of the arm portion is capable of coming face to face with part of the housing in a direction along a lead-out direction of the cable from the one of the cable holders at the time and after mounting of the one of the cable holders on the housing, the one of the cable holders has a first locking protruding portion at the single cantilevered arm portion, the one of the cable holders has a second locking protruding portion at a part of the one of the cable holders other than the single cantilevered arm portion, the second locking protruding portion protruding perpendicularly to the lead-out direction, the one of the cable holders has a side surface that is parallel to the mounting direction and parallel to the lead-out direction, the first locking protruding portion protrudes from the single cantilevered arm portion in a first direction perpendicular to the side surface, the second locking protruding portion protrudes from the side surface in a second direction perpendicular to the side surface, the first direction is opposite to the second direction, the one of the cable holders includes a protruding portion vertically arranged in the mounting direction of the one of the cable holders, on a mounting side of the one of the cable holders on the housing, the protruding portion is positioned adjacent to and before the single cantilevered arm portion in the lead out direction, the one of the cable holders and the housing are provided with the first locking protruding portion and a corresponding locking portion, respectively, along the mounting direction, the one of the cable holders has, along the mounting direction, a locking completion position where the first locking protruding portion and the corresponding locking portion are already locked, and a temporary fixing position where the first locking protruding portion and the corresponding locking portion are not yet locked, at the temporary fixing position, the first locking protruding portion collides with part of the housing, and the one of the cable holders is positioned in a state of being further apart in the mounting direction from the housing than at the locking completion position, and upon the one of the cable holders being at the locking completion position, the protruding portion of the one of the cable holders is placed in a state of being in close proximity to the other cable holder in a direction along the mounting direction.

2. The cable connector according to claim 1, wherein the second locking protruding portion provided to the part other than the arm portion is spaced apart from the arm portion in the direction along the lead-out direction of the cable.

3. The cable connector according to claim 1, wherein the first locking protruding portion is provided near a free end of the elastically displaceable arm portion.

4. The cable connector according to claim 1, wherein the housing further includes a terminal support that is capable of holding a terminal, and the corresponding locking portion is provided to the terminal support.

5. The cable connector according to claim 1, wherein the cable holders are formed in a pair having substantially the same size and shape.

6. The cable connector according to claim 1, wherein the one of the cable holders has a surface from which the single cantilevered arm portion protrudes, and the side surface of the one of the cable holders is perpendicular to the surface from which the single cantilevered arm portion protrudes.

7. The cable connector according to claim 1, wherein the single cantilevered arm portion is coupled to the side surface of the one of the cable holders in a state of being flush with the side surface of the one of the cable holders.

8. The cable connector according to claim 1, wherein the single cantilevered arm portion has a surface that is parallel to the mounting direction, and the surface of the single cantilevered arm portion is coplanar with the side surface of the one of the cable holders.

9. The cable connector according to claim 1, wherein the first cantilevered arm portion has a length same as a length of the protruding portion.

* * * * *